US006494452B1

(12) United States Patent
Karasiewicz

(10) Patent No.: US 6,494,452 B1
(45) Date of Patent: Dec. 17, 2002

(54) METHOD AND APPARATUS TO DECELERATE PRINTED PRODUCT IN A STACKING PROCESS

(76) Inventor: Krzysztof Karasiewicz, 714 Summer St., Elizabeth, NJ (US) 07202

( * ) Notice: Subject to any disclaimer, the term of this patent is extended or adjusted under 35 U.S.C. 154(b) by 181 days.

(21) Appl. No.: 09/691,737

(22) Filed: Oct. 19, 2000

(51) Int. Cl.[7] ..... B65H 5/02

(52) U.S. Cl. ..... 271/276; 271/183; 271/195; 271/197

(58) Field of Search ..... 271/276, 182, 271/194, 195, 196, 197, 183

(56) References Cited

U.S. PATENT DOCUMENTS

| | | | | |
|---|---|---|---|---|
| 3,545,746 A | * | 12/1970 | Ledger et al. | |
| 3,941,374 A | | 3/1976 | Vits | 271/183 |
| 3,945,634 A | | 3/1976 | Calvert | 271/183 |
| 4,019,731 A | | 4/1977 | Vits | 271/183 |
| 4,247,094 A | | 1/1981 | Vits | 271/183 |
| 4,310,152 A | * | 1/1982 | Mitzel | 271/196 X |
| 4,346,881 A | | 8/1982 | Frye | 271/208 |
| 4,440,388 A | * | 4/1984 | Divoux et al. | 271/195 |
| 4,625,956 A | | 12/1986 | Marass et al. | 271/183 |
| 4,662,622 A | * | 5/1987 | Wimmer et al. | 271/196 X |
| 4,667,949 A | | 5/1987 | Goodwin et al. | 271/207 |
| 4,824,092 A | | 4/1989 | Kriefall et al. | 271/183 |
| 5,060,928 A | | 10/1991 | Vits | 271/182 |
| 5,183,252 A | * | 2/1993 | Wolber et al. | 271/276 |
| 5,329,301 A | * | 7/1994 | Balzeit et al. | 271/194 X |
| 5,913,268 A | * | 6/1999 | Jackson et al. | 271/195 X |
| 5,957,050 A | | 9/1999 | Scheffer et al. | 101/227 |

* cited by examiner

*Primary Examiner*—David Bollinger
(74) *Attorney, Agent, or Firm*—Walter J. Tencza, Jr.

(57) ABSTRACT

An apparatus and method to decelerate printed product in a stacking process is provided. The printed product may be a product such as printed paper, foil, or plastic. A continuous web of product may be cut into single items, one item at a time, and then the items may be stacked on top of one another. The apparatus may be comprised of a cylinder, which is comprised of a vacuum chamber having perforations and a blowing chamber having perforations. A first slow delivery tape, and first and second fast delivery tapes may also be provided. Each of the delivery tapes may have perforations to allow air to pass through and from or to the cylinder. The first slow delivery tape is wrapped around the cylinder. The first and second fast delivery tapes are wrapped around rollers and may help to create separation between individual cut items and may control moving items. The first slow delivery tape may slow down items to allow stacking of items. The apparatus may also include first and second brushes ratably connected to housing. One or the other brush can push down on individual items to move an item closer towards the cylinder. The apparatus may additionally include a cutting device, which cuts individual items from a continuous web. The slow delivery tapes may also travel over a slow delivery tape vacuum and the second fast delivery tapes may travel over a fast delivery vacuum.

22 Claims, 20 Drawing Sheets

Section X - X
FROM FIG. 3B

Section Y - Y
FROM FIG. 3D

Section Z - Z
FROM FIG. 3F

METHOD AND APPARATUS TO DECELERATE PRINTED PRODUCT IN A STACKING PROCESS

FIELD OF THE INVENTION

This invention relates to improved methods and apparatus for moving pieces of cut product in a conveyor or printer system.

BACKGROUND OF THE INVENTION

Various apparatus and method are known for moving products on conveyors and for providing printed items or products, such as printed papers.

SUMMARY OF THE INVENTION

The present invention in one embodiment provides an apparatus and method to decelerate printed product in a stacking process. The printed product may be products such as printed paper, foil, or plastic. The finishing stage in web printing processing of materials, like paper, foil, and plastic is cutting and stacking. The equipment in this process are sheeters, rotary cutters, etc. A continuous web of product is usually cut into single items, one item at a time, and then the items need to be stacked on top of one another.

The present invention in one embodiment discloses an apparatus for moving items comprised of a cylinder wherein the cylinder is comprised of a vacuum chamber and a blowing chamber. The items may be pieces of product. Each item or piece of product may be an individually cut piece of paper from a continuous web of paper.

The cylinder may be comprised of a plurality of cylinder perforations, which allow air from the blowing chamber to be blown out of the cylinder perforations. The same cylinder perforations may also allow air to be sucked into the vacuum chamber through the cylinder perforations. Note that the same cylinder perforations may be used to vacuum and to blow air in different times and in different areas.

The apparatus of one embodiment of the present invention may also include a first slow delivery tape which is wrapped around the cylinder, and which can transport items. The apparatus may be further comprised of a plurality of first fast delivery tape rollers and a first fast delivery tape which is wrapped around the plurality of first fast delivery tape rollers. At least a portion of the first fast delivery tape may lie above at least a portion of the first slow delivery tape. A plurality of first slow delivery tapes and a plurality of first fast delivery tapes analogous to the above may be provided.

The apparatus may also include a first brush disc ratably connected to a housing. The first brush disc may include a first brush which can push down a first piece of product to move the first piece of product closer towards blowing vacuum cylinder. A plurality of further brush discs may also be provided. Each brush disc may be connected to a shaft, which may be connected to housing members by bearings.

The apparatus of one embodiment of the present invention may also be comprised of a plurality of second fast delivery tape rollers, and a second fast delivery tape which is wrapped around the plurality of second fast delivery tape rollers. At least a portion of each of the second fast delivery tape can lie below a portion of the first fast delivery tape. At least a portion of the first fast delivery tape and at least a portion of the second fast delivery tape can act together to move items. The apparatus may additionally comprise a cutting device, which cuts pieces of paper from a continuous web of paper. A slow delivery tape vacuum may also be provided in the apparatus of the first embodiment, wherein each the slow delivery tape may move over the slow delivery tape vacuum in order to transport an item. The slow delivery tape may have a plurality of perforations and the slow delivery tape vacuum may have a long opening. The slow delivery tape vacuum may have supporting rollers inside the long vacuum opening, to support the slow delivery tape. The slow delivery tape vacuum may draw air in through the perforations of the slow delivery tape and through the supporting rollers in the slow delivery tape vacuum. A plurality of slow delivery tapes, slow delivery tape vacuums, second fast delivery tapes, and first fast delivery tapes may be provided.

The apparatus of the first embodiment may also be comprised of a fast delivery tape vacuum wherein the first fast delivery tape moves under the fast delivery tape vacuum in order to transport an item. The first fast delivery tape may have a plurality of perforations and the fast delivery tape vacuum may have a plurality of perforations. The fast delivery tape vacuum may draw air in through the perforations in the first fast delivery tape and through the perforations in the fast delivery tape vacuum. The apparatus may be comprised of a plurality of such fast delivery tape vacuums and first fast delivery tapes.

A first item, particularly a first piece of paper cut from a continuous web of paper; may be moved by the apparatus in a first direction by the first and second fast delivery tapes. A front portion of the first piece of paper may be pushed upwards by the blowing air emitted from the blowing vacuum cylinder. A rear portion of the first piece of paper may be pushed downwards by a plurality of first pressing brushes of the corresponding plurality of first pressing brush disc and sucked downwards by the vacuum portion of the blowing vacuum cylinder. The first piece of paper may be further moved in the first direction by a plurality of the slow delivery tape.

The apparatus in a first direction may move a second item, particularly a second piece of paper cut from a continuous web of paper by the first and second fast delivery tapes. A front portion of the second piece of paper may be pushed upwards by blowing air emitted from the blowing vacuum cylinder. A rear portion of the second piece of paper may be pushed downwards by a plurality of second pressing brushes, of the corresponding plurality of first pressing brush discs and sucked downwards by the vacuum portion of the blowing vacuum cylinder. The second piece of paper may be further moved in the first direction by the plurality of slow delivery tapes. The second piece of paper may be stacked on top of the first piece of paper, so that the second piece of paper overlaps the first piece of paper with a constant offset.

DETAILED DESCRIPTION OF THE DRAWINGS

Figure 1:
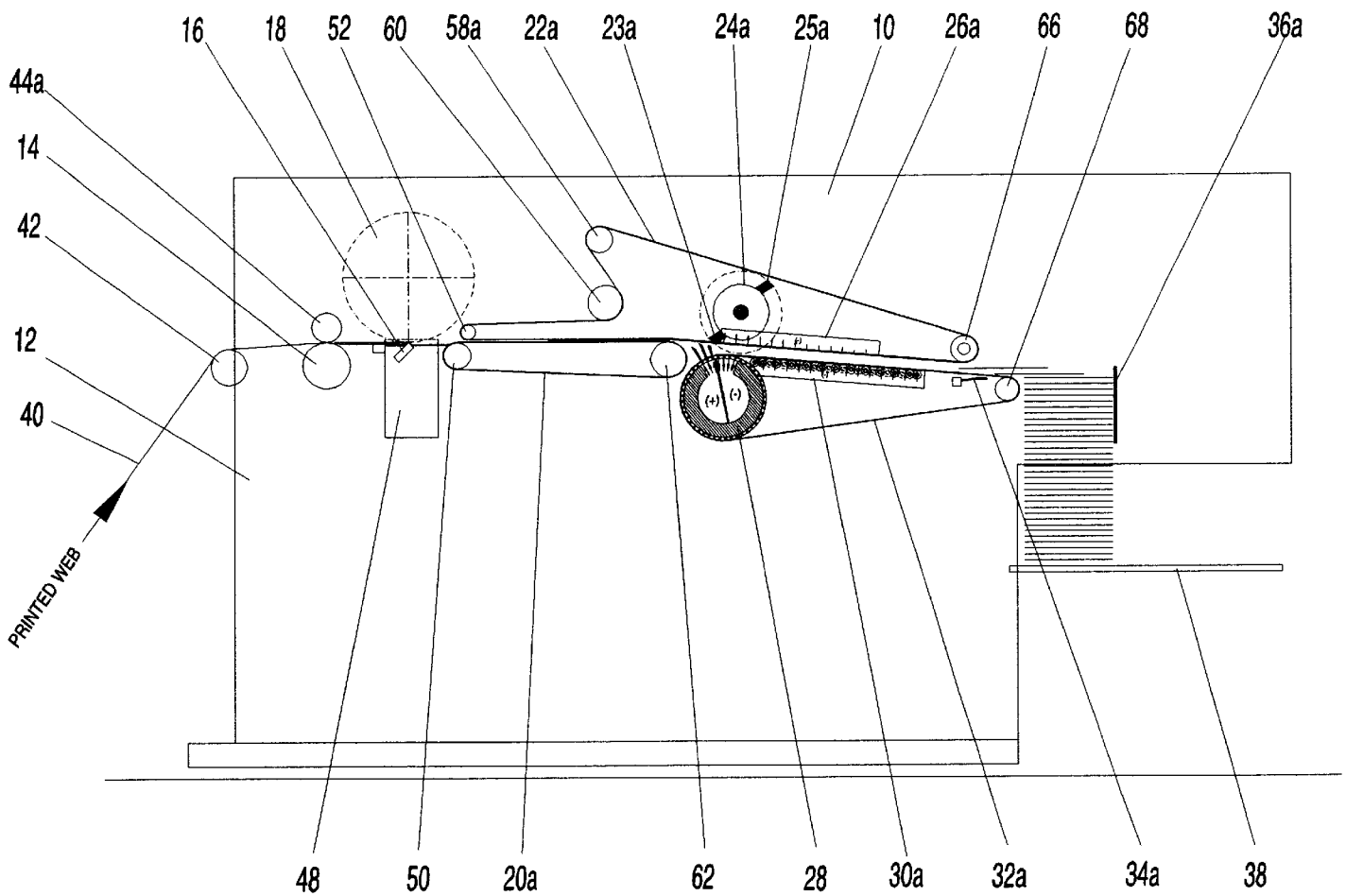
FIG. 1 shows a side cross sectional view of an apparatus for cutting and stacking printed product in accordance with an embodiment of the present invention.

FIG. 1 shows a side cross sectional view of apparatus 10 comprised of shear cutting section 12, feed roller 14, stationary knife 16, rotary knives cylinder 18, a plurality of second fast delivery tapes 20*a–f*, a plurality of first fast delivery tapes 22*a–f*, a plurality of first pressing brush discs 24*a–e* with set of brushes 23*a–e* and 25*a–e*, a plurality of fast delivery tape vacuums 26*a–f*, blowing vacuum cylinder 28, plurality of slow delivery tape vacuums 30*a–e*, plurality of perforated slow delivery tapes 32*a–e*, plurality of air nozzles 34*a–d*, a plurality of stop plates 36*a–f*, piling system 38, input roller 42, plurality of nip wheels 44*a–d*, stationary knife support 48, second fast delivery front roller 50, first fast delivery front roller 52, plurality of first fast delivery tape tension pulleys 58*a–f*, first fast delivery drive roller 60, second fast delivery drive roller 62, first fast delivery rear roller 66, and slow delivery drive roller 68. Some of the components of the apparatus 10 are not shown in FIG. 1 but are shown in other figures, such as FIG. 2 and FIG. 4A.

The stationary knife 16 and the rotary knives cylinder 18 may be thought of as being part of a cutting device.

A continuous printed web 40 of material is shown being fed into the apparatus 10. The continuous printed web 40 may be a continuous web of printed paper.

Figure 2:
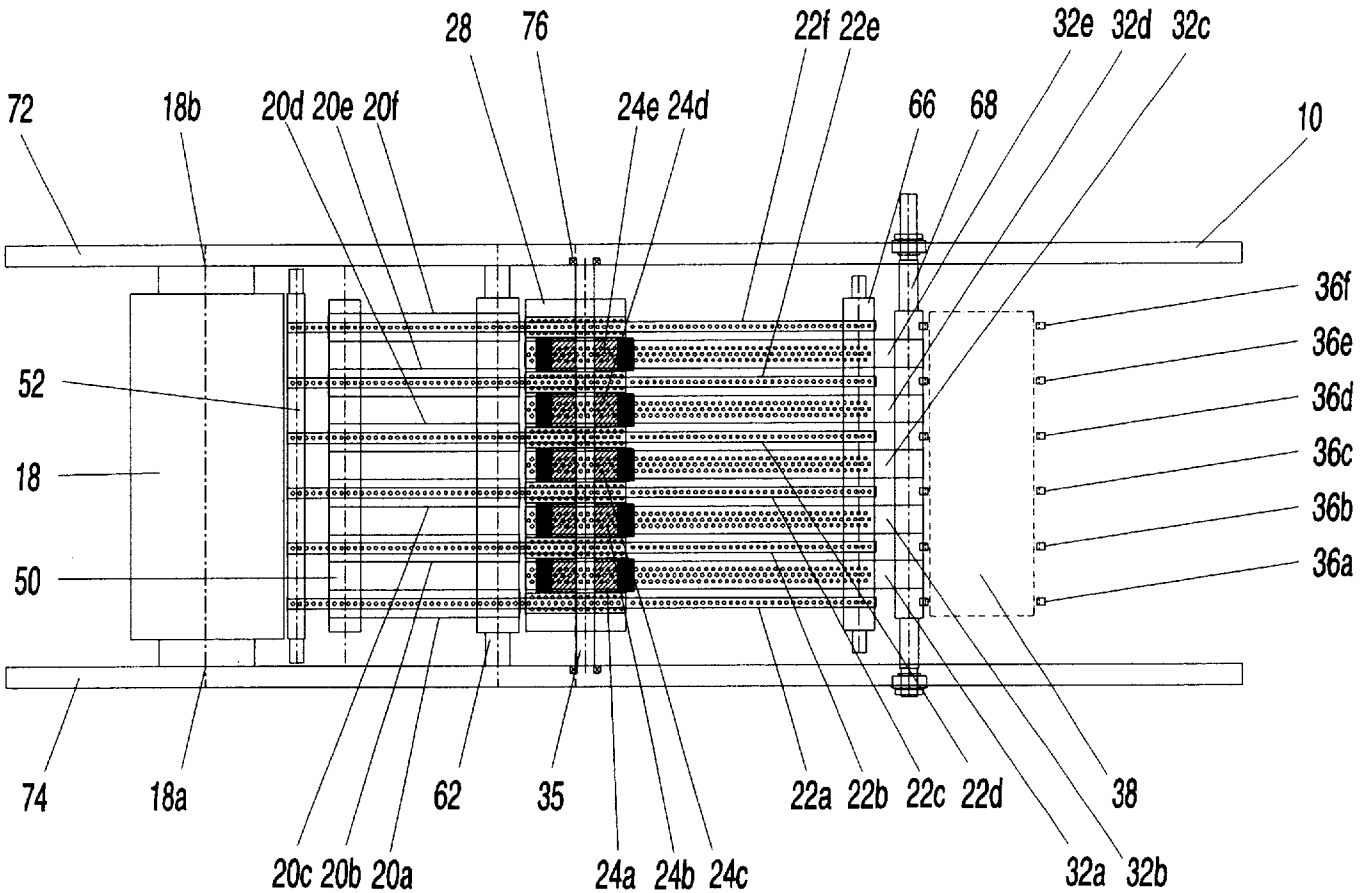
FIG. 2 shows a top sectional view of the apparatus of FIG. 1.

FIG. 2 shows a top sectional view of the apparatus 10 of FIG. 1. As shown in FIG. 2, the plurality of slow delivery tapes 32*a–e* include tapes 32*a*, 32*b*, 32*c*, 32*d*, and 32*e*. The perforations in each of these slow delivery tapes 32*a–e* allow air from the blowing vacuum cylinder 28 and slow delivery tape vacuums 30*a–e*, to pass through the perforations. The second fast delivery tapes 20*a–f* include tapes 20*a*, 20*b*, 20*c*, 20*d*, 20*e*, and 20*f*. Between rotary knives cylinder 18 and blowing vacuum cylinder 28 there may be four rollers, 50, 52, 60, and 62 and individual first fast delivery tape tension pulleys 58*a*–58*f*. Some of these components are shown in FIG. 2 or in other figures.

FIG. 2 also shows rotary knives cylinder 18 connected through rotary knife cylinder ends 18*a* and 18*b* to members 72 and 74 by cylinder bearings (cylinder bearings not shown)

Note that the stop plates 36*a–f* may be in pieces as it is shown in FIG. 2.

Figure 3A:
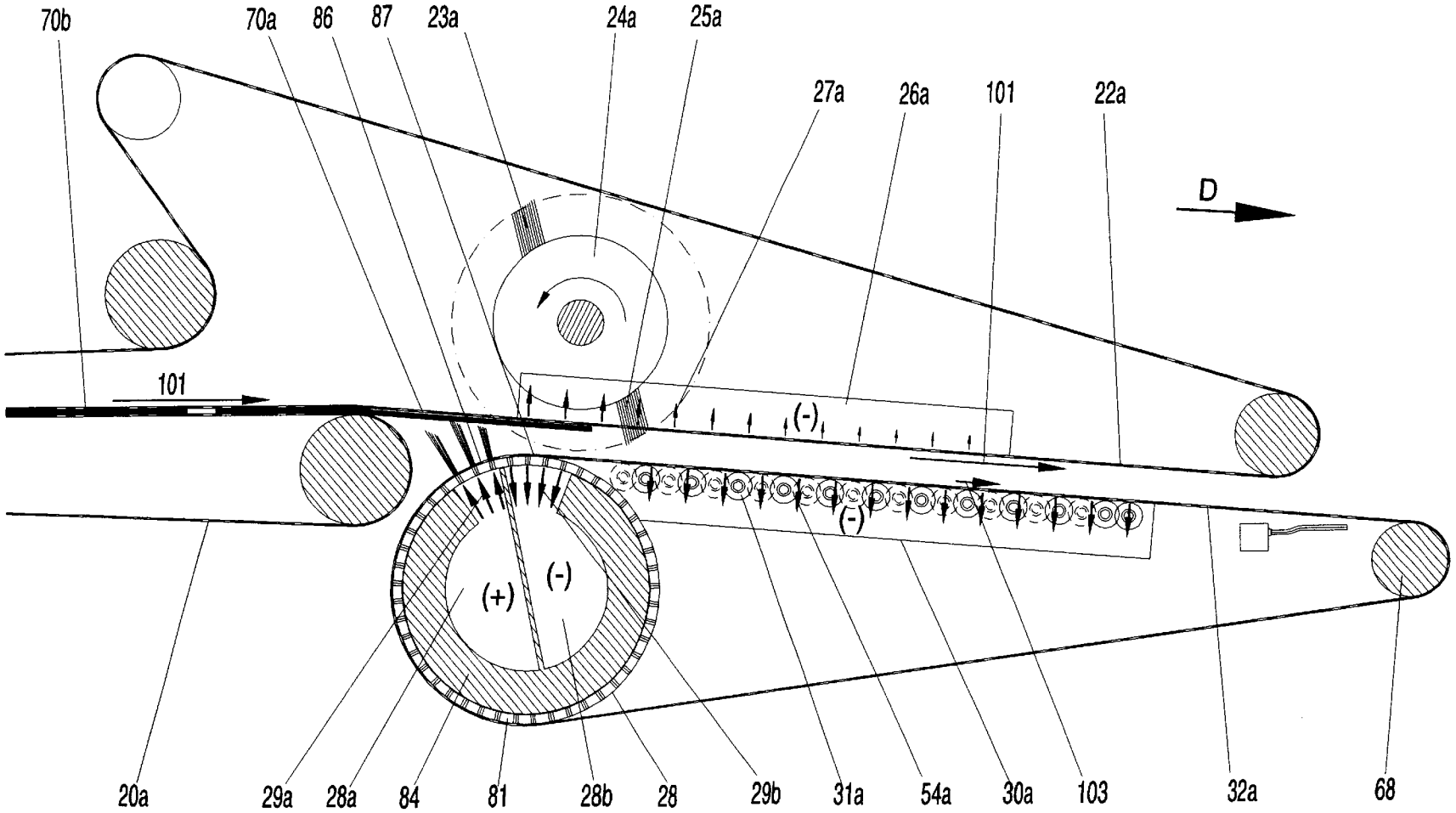
FIG. 3A shows a side cross sectional view of part of the apparatus of FIG. 1, in a first state, when first and second pieces of product are located at first and second positions, respectively.

FIG. 3A shows a side cross sectional view of part of the apparatus 10 of FIG. 1, in a first state, when a first piece of product 70*a* is located at a first position and second piece of product 70*b* is located at a second position, respectively. The pieces of product 70*a* and 70*b* may also be called items. The first and second pieces of product 70*a–b*, may each piece of piece of paper that was cut off from a continuous web 40 of printed paper. FIG. 3A shows first and second pressing brushes 23*a–e* and 25*a–e* from first pressing-brush disc 24*a–e*. Arrows 29*a* in FIG. 3A indicate that air is being blown or emitted from the blowing portion 86 of the blowing vacuum cylinder 28 as shown. Arrows 29*b* indicate that air is being drawn in or sucked into the vacuum portion 87 of the blowing vacuum cylinder 28 as shown. Thus blowing-vacuum cylinder 28 blows air outwards in one area (blowing portion 86) and sucks in air in another area (vacuum portion 87).

Product 70*a* moves horizontally in direction D. Applying suction to first fast delivery tapes 22*a–f* through the tape openings holds the front portion of product 70*a* by fast delivery tape vacuums 26*a–f* shown by arrows 27*a–f*. In this same state blowing vacuum cylinder 28 blows air from blowing portion 86 on middle portion of product 70*a* (arrows 29*a*), pressing and holding it against first fast delivery tapes 22*a–f*. Both of them keep product 70*a* away from suction of blowing vacuum cylinder vacuum portion 87 shown as arrows 29*b*. Rear portion of product 70*a* is fully controlled by first and second fast delivery tapes 22*a–f* and 20*a–f*. Product 70*a* is moved with first and second fast delivery tapes speed, which is called the fast delivery tape speed 101.

Product 70*b* is fully controlled by first and second fast delivery tapes 22*a–f* and 20*a–f* and moved horizontally in direction D with fast delivery tapes speed 101.

Figure 3B:
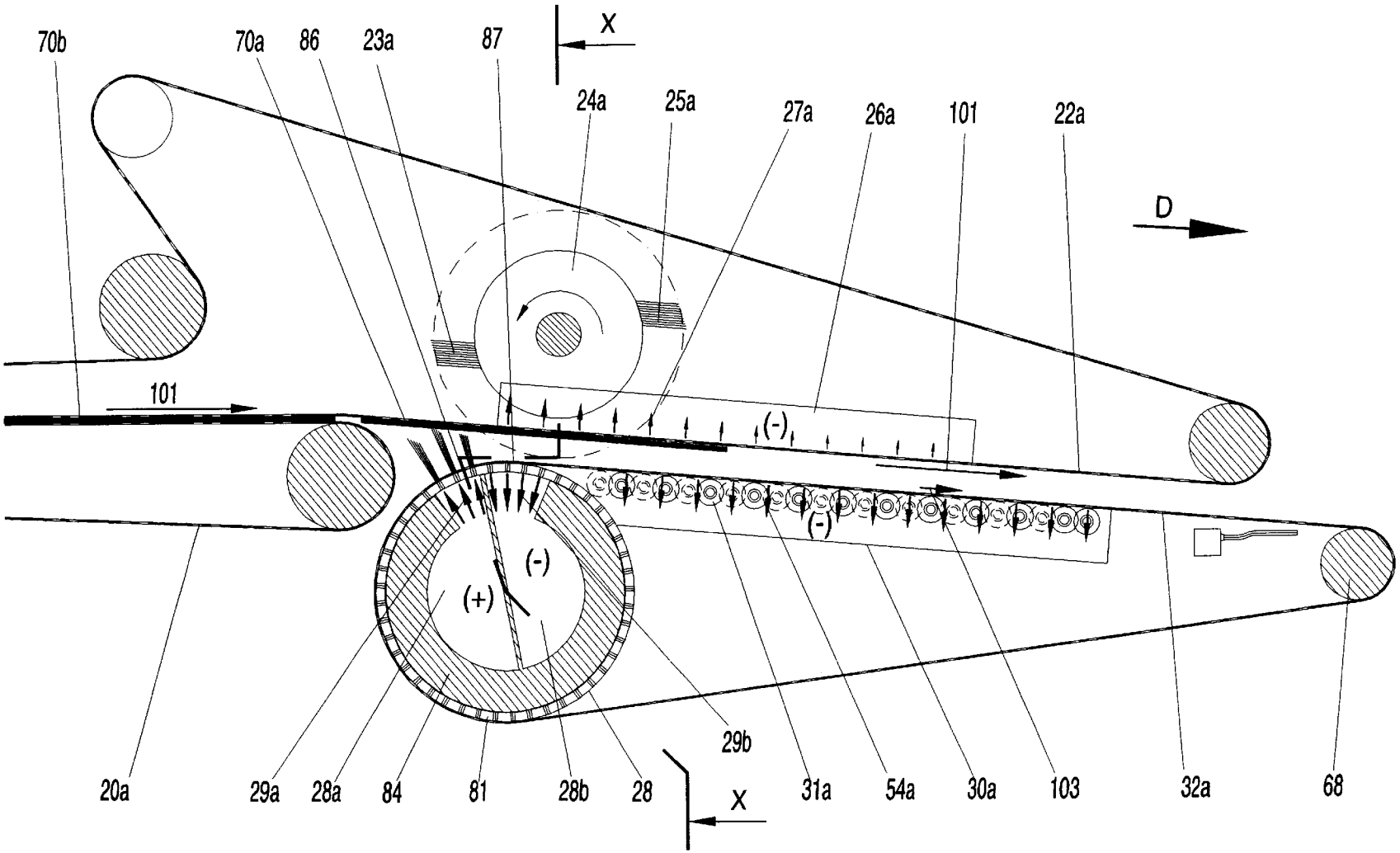
FIG. 3B shows a side cross sectional view of part of the apparatus of FIG. 1, in a second state, when first and second pieces of product are located at third and fourth positions, respectively.

FIG. 3B shows a side cross sectional view of part of the apparatus 10 of FIG. 1, in a second state, when the first piece of product 70*a* is located at a third position and the second piece of product 70*b* is located at a fourth position.

The product 70*a* has moved horizontally in direction D from the position in FIG. 3A to the position on FIG. 3B with fast delivery tapes speed 101. Front and middle portion of product 70*a* is held by applying suction to first fast delivery tapes 22*a–f* through holes in tapes by fast delivery tapes vacuum 26*a–f* shown by arrows 27*a–f*. In this same state blowing vacuum cylinder 28 blows air from blowing portion 86 on rear portion of product 70*a* (arrows 29*a*) pressing and holding it against first fast delivery tapes 22*a–f*. Both of them keep product 70*a* away from suction of blowing vacuum cylinder vacuum portion 87 shown by arrows 29*b* and suction of slow delivery tape vacuums 30*a–e* shown by arrows 54*a–e*.

The product 70*b* has moved horizontally in direction D from position in FIG. 3A to the position in FIG. 3B and is fully controlled by first and second fast delivery tapes 22*a–f* and 20*a–f* and moved with fast delivery tapes speed 101.

Figure 3C:
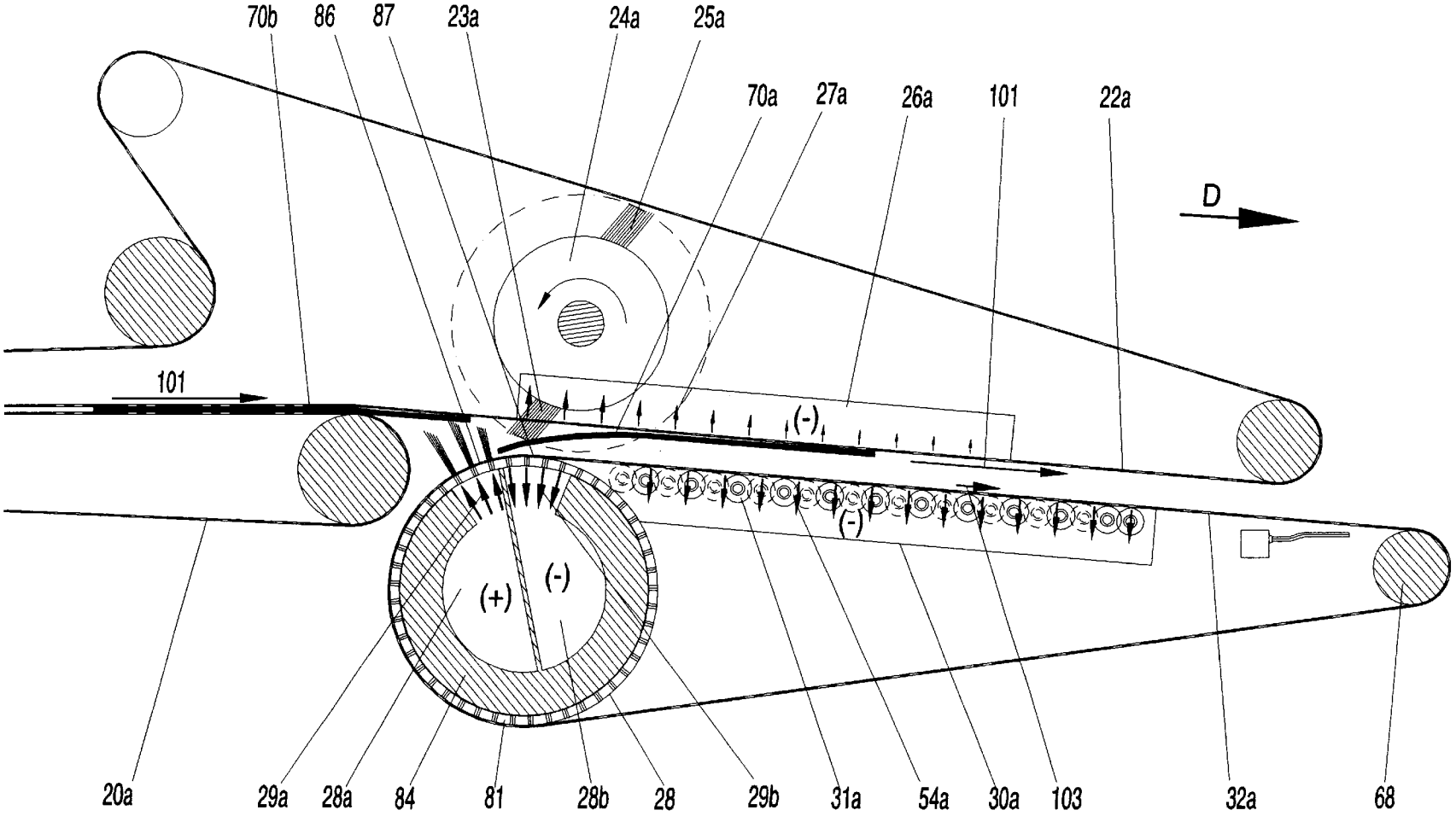
FIG. 3C shows a side cross sectional view of part of the apparatus of FIG. 1, in a third state, when first and second pieces of product are located at fifth and sixth positions, respectively.

FIG. 3C shows a side cross sectional view of part of the apparatus 10 of FIG. 1, in a third state, when the first piece of product 70*a* is located at a fifth position and the second piece of product 70*b* is located at a sixth position. The product 70*a* has moved horizontally in direction D from the position in FIG. 3B to the position in FIG. 3C. The front and middle portion of the product 70*a* is shown in FIG. 3C is held by applying suction to the first fast delivery tapes 22*a–f* by fast delivery tape vacuums 26*a–f* (arrows 27*a–f*). Rear portion of the product 70*a* starts to be pressed down by the rotated set of first pressing brushes 23*a–e* from the set of first pressing brushes discs 24*a–e* against vacuum portion 87 of blowing vacuum cylinder 28. In this same state the blowing vacuum cylinder 28 sucks down this portion of the product to the surface of cylinder vacuum portion 87 shown by arrows 29*b*. Blowing vacuum cylinder is driven by slow delivery drive roller 68 through slow delivery tapes 32*a–e* and run with peripheral speed, same value like linear speed of slow delivery tapes, but 7–10 times slower than fast delivery tapes speed 101. Peripheral blowing vacuum cylinder speed and slow delivery tapes speed have called slow delivery speed 103 see FIG. 3C. Speed of product 70*a* is subject to suction of fast delivery tape vacuums 26*a–f* shown by arrows 27*a–f* and suction of blowing vacuum cylinder 28 shown by arrows 29*b*. Because suction of blowing vacuum cylinder 28 is greater than suction of upper fast delivery tapes vacuums 26*a–f* and slow delivery speed 103 is 7–10 times smaller than fast delivery tapes speed 101, product 70*a* starts to be controlled by blowing vacuum cylinder 28 and brake down speed from fast delivery tapes speed 101 to slow delivery speed 103. To fully control brake down speed of the product 70*a*, first fast delivery tapes 22*a–f* have to have low surface friction and blowing vacuum cylinder has to have high surface friction coated by rubber, urethane or by other high friction material.

The product 70*b* has moved horizontally in direction D from the position in FIG. 3B to the position 3C. Blowing vacuum cylinder 28 blows air from blowing portion 86 on front portion of the product 70*b* (arrows 29*a*) pressing and holding it against first fast delivery tapes 22*a–f* and keep product away from suction of blowing vacuum cylinder vacuum portion 87 shown by arrows 29*b*. Middle and rear portion of product 70*b* is fully controlled by first and second fast delivery tapes 22*a–f* and 20*a–f*. Product 70*b* moves with fast delivery tapes speed 101.

Figure 3D:
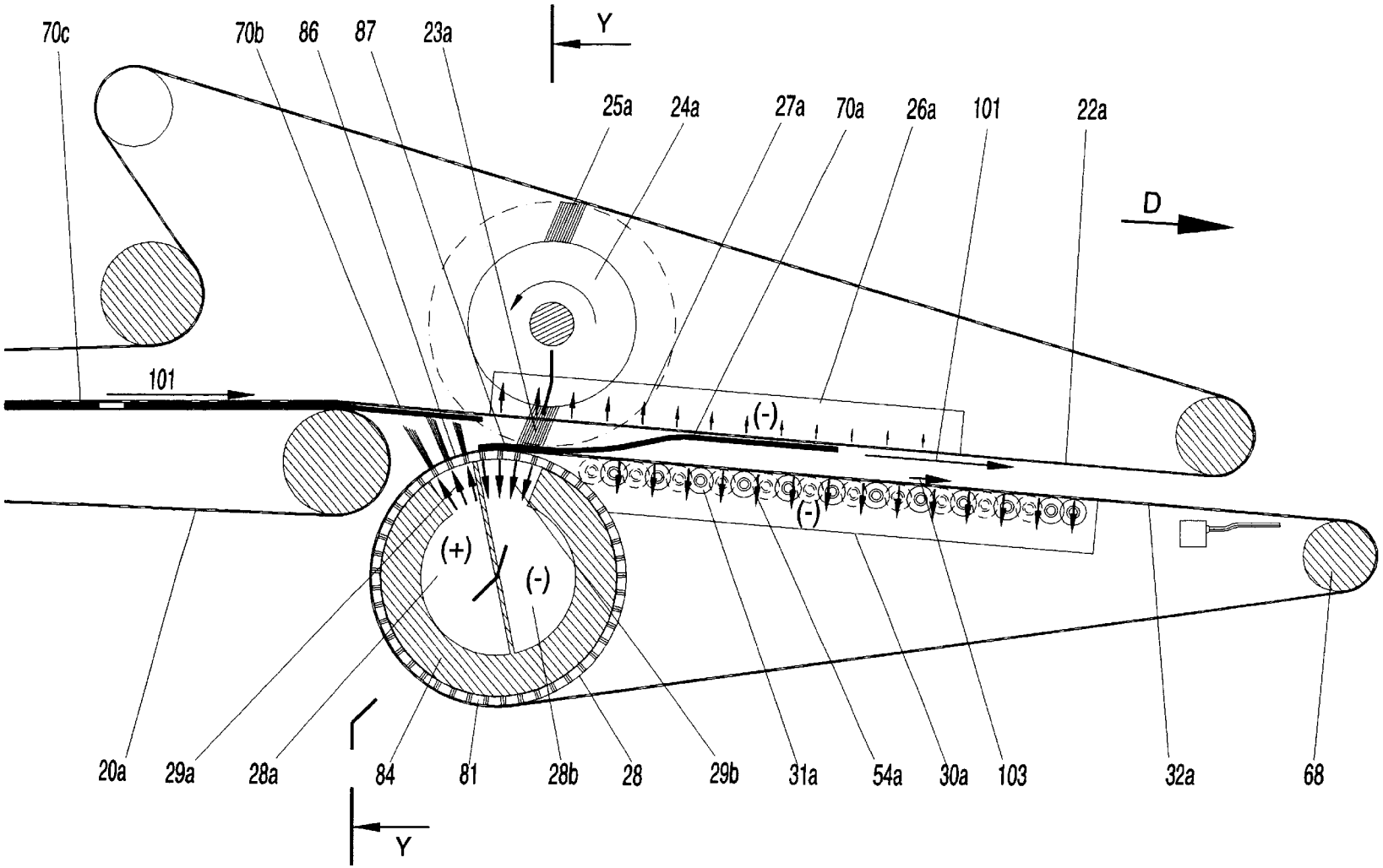
FIG. 3D shows a side cross sectional view of part of the apparatus of FIG. 1, in a fourth state, when first, second, and third pieces of product are located at seventh, eighth, and ninth positions, respectively.

FIG. 3D shows a side cross sectional view of part of the apparatus 10 of FIG. 1, in a fourth state, when the first piece of product 70*a* is located at a seventh position, the second piece of product 70*b* is located at a eighth position and the third piece of Product 70*c* is located at ninth position. The product 70*a* has moved horizontally in direction D from the position in FIG. 3C to position in FIG. 3D with slow delivery speed 103. First set of pressing brushes 23*a–e* from the first set of pressing brushes discs 24*a–e* rotate and more press rear portion of product 70*a* against blowing vacuum cylinder and bigger area of product 70*a* sticks to surface of vacuum portion 87 of blowing vacuum cylinder 28 and slow delivery tapes 32*a–e*. Part of the middle and front portion of the product 70*a* is sucked by first fast delivery tapes 22*a–f* through openings in tapes by fast delivery tapes vacuums 26*a–f* (arrows 27*a–f*) but it slips over tapes low friction surfaces.

The product 70*b* has moved horizontally in direction D from the position in FIG. 3C to the position 3D. Blowing vacuum cylinder 28 blows air from blowing portion 86 on front portion of the product 70*b* (arrows 29*a*), pressing and holding it against first fast delivery tapes 22*a–f* and keeping product away from suction of blowing vacuum cylinder vacuum portion 87 shown by arrows 29*b*. Middle and rear portion of product 70*b* is fully controlled by first and second fast delivery tapes 22*a–f* and 20*a–f*. Product 70*b* moves with fast delivery tapes speed 101.

Product 70*c* is fully controlled by first and second delivery tapes 22*a–f* and 20*a–f* and moved horizontally in direction D with fast delivery tapes speed 101.

Figure 3E:
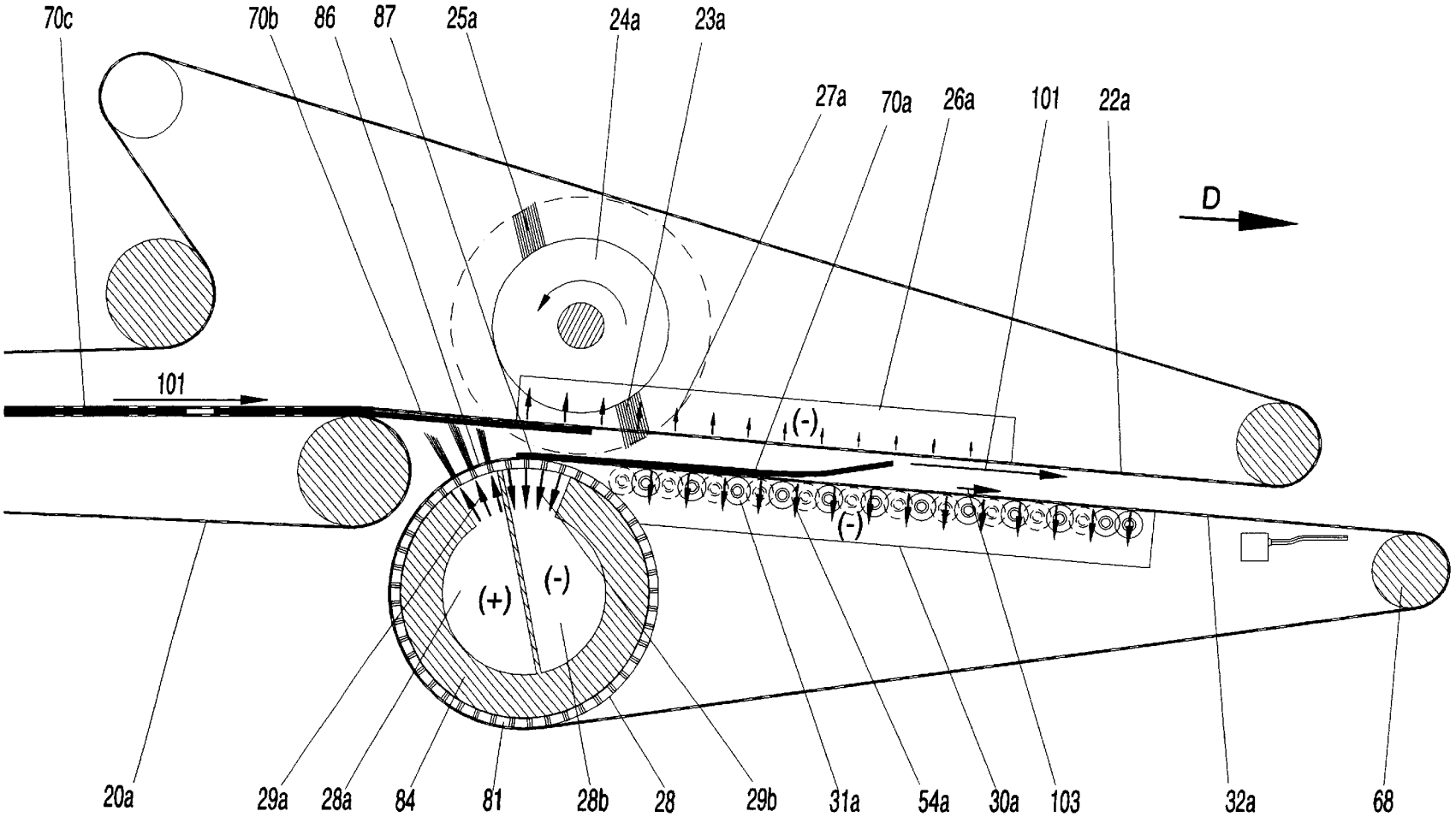
FIG. 3E shows a side cross sectional view of part of the apparatus of FIG. 1, in a fifth state, when first, second, and third pieces of product are located at tenth, eleventh, and twelfth positions, respectively.

FIG. 3E shows a side cross sectional view of part of the apparatus 10 of FIG. 1, in a fifth state, when the first piece of product 70*a* is located at a tenth position and the second piece of product 70*b* is located at eleventh position and the third piece of product 70*c* is located at a twelfth position. The product 70*a* has moved horizontally from the position in FIG. 3D to the position in FIG. 3E so that the product 70*a* has moved with slow delivery speed 103. Rear portion of product 70*a* sticks to the vacuum portion 87 of blowing vacuum cylinder 28. Front portion of the products is sucked up by first fast delivery tapes 22*a–f* through opening in tapes by fast delivery tapes vacuums 26*a–f*, but slips over low friction surface of tapes. In this same time slow delivery tape vacuums 30*a–e* suck down middle and latter front portion of product 70*a* to perforated slow delivery tapes 32*a–e* through tape openings by slow delivery tapes vacuum 30*a–e* shows arrows 54*a–e* and front and middle portion of product start to stick to slow delivery tapes 32*a–e* as shown in FIG. 3E.

FIG. 3E shows slow delivery tapes supporting rollers 31*a–e* as a pair of slow delivery tape vacuums 30*a–e* to support tapes during applying suction (arrows 54*a–e*).

Product 70*b* moves horizontally in direction D from the position in FIG. 3D to the position in FIG. 3E. The front portion is held by applying suction to first fast delivery tapes 22*a–f* through tapes openings by fast delivery tapes vacuums 26*a–f* shown by arrows 27*a–f*. In this same state blowing vacuum cylinder 28 blows air from blowing portion 86 on middle portion of product 70*b* (arrows 29*a*), pressing and holding it against first fast delivery tapes 22*a–f*. Both of them keep product 70*b* away from suction of blowing vacuum cylinder vacuum portion 87 shown by arrows 29*b*. Rear portion of product 70*b* is fully controlled by first and second fast delivery tapes 22*a–f* and 20*a–f*. Product 70*b* is moved with fast delivery tapes speed 101.

The product 70*c* has moved horizontally in direction D from position in FIG. 3D to the position in FIG. 3E and is fully controlled by first and second fast delivery tapes 22*a–f* and 20*a–f* and moved with fast delivery tapes speed 101.

Figure 3F:
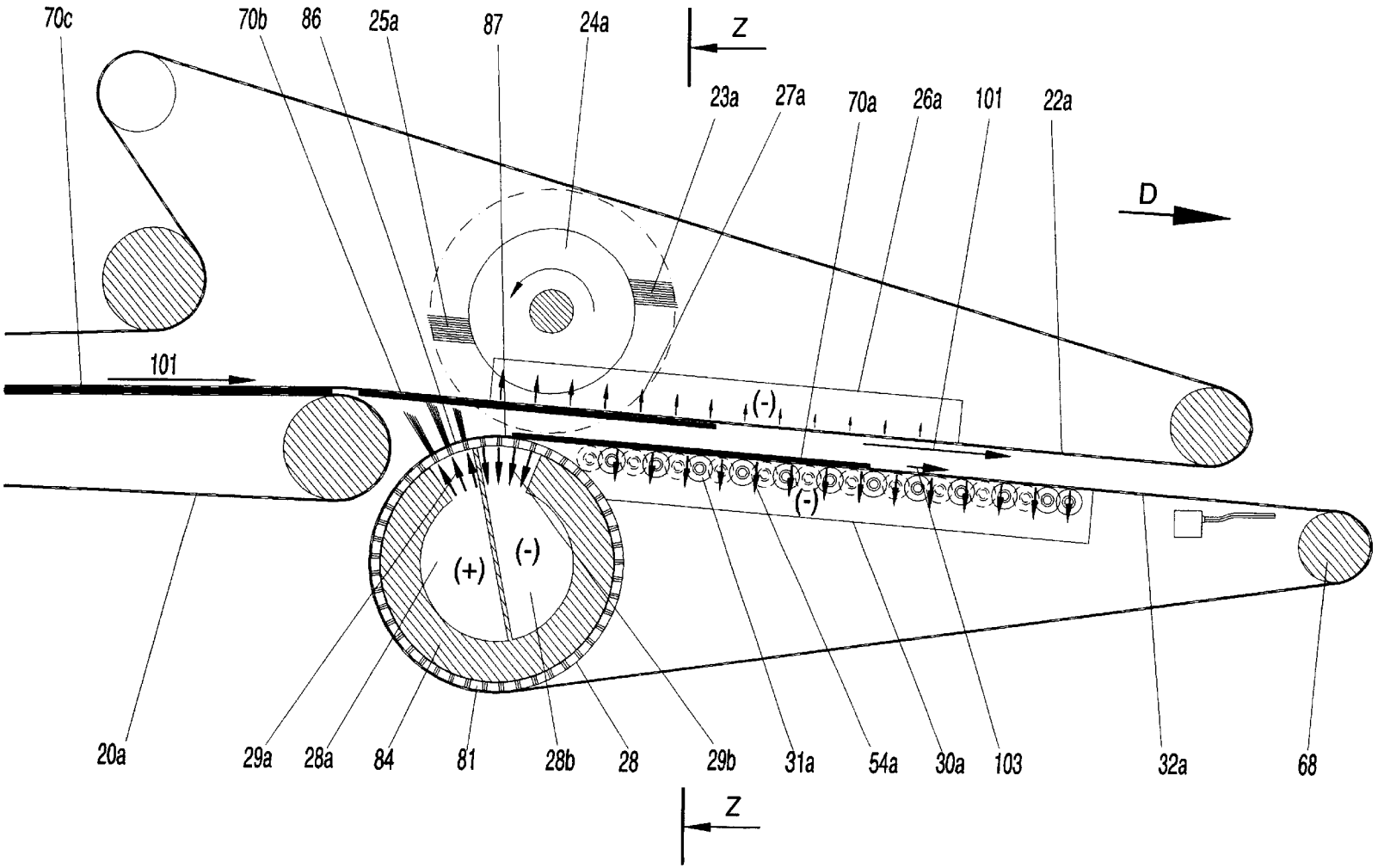
FIG. 3F shows a side cross sectional view of part of the apparatus of FIG. 1, in a sixth state, when first, second, and third pieces of product are located at thirteenth, fourteenth, and fifteenth positions, respectively.

FIG. 3F shows a side cross sectional view of part of the apparatus 10 of FIG. 1, in a sixth state, when the first piece of product 70*a* is located at a thirteenth positicn and the second piece of product 70*b* is located at a fourteenth position, and a third piece of product 70*c* is located at a fifteenth position. The product 70*a* has moved horizontally from the position in FIG. 3E to the position in FIG. 3F so that the product 70*a* has moved out off the vacuum portion 87, of cylinder 28 further in the direction D. Product 70*a* moved with slow delivery speed 103 and starts to be controlled only by perforated slow delivery tapes 32*a–e* by applying suction (shown by arrows 54*a–e*) through tapes openings by slow delivery tapes vacuums 30*a–e*.

The product 70*b* has moved horizontally in direction D from the position in FIG. 3E to the position in FIG. 3F with fast delivery tapes speed 101. Front and middle portion of product 70*b* is held by applying suction to first fast delivery tapes 22*a–f* through holes in tapes by fast delivery tapes vacuums 26*a–f* shown by arrows 27*a–f*. In this same state blow vacuum cylinder 28 blows air from blowing portion 86 on rear portion of product 70*b* (arrows 29*a*) pressing and holding it against first fast delivery tapes 22*a–f*. Both of them keep product 70*b* away from suction of blowing vacuum cylinder vacuum portion 87 shown as arrows 29*b*.

The product 70*c* has moved horizontally in direction D from position in FIG. 3E to the position in FIG. 3F and is fully controlled by first and second fast delivery tapes 22*a–f* and 20*a–f* and moved with fast delivery tapes speed 101.

Figure 3G:
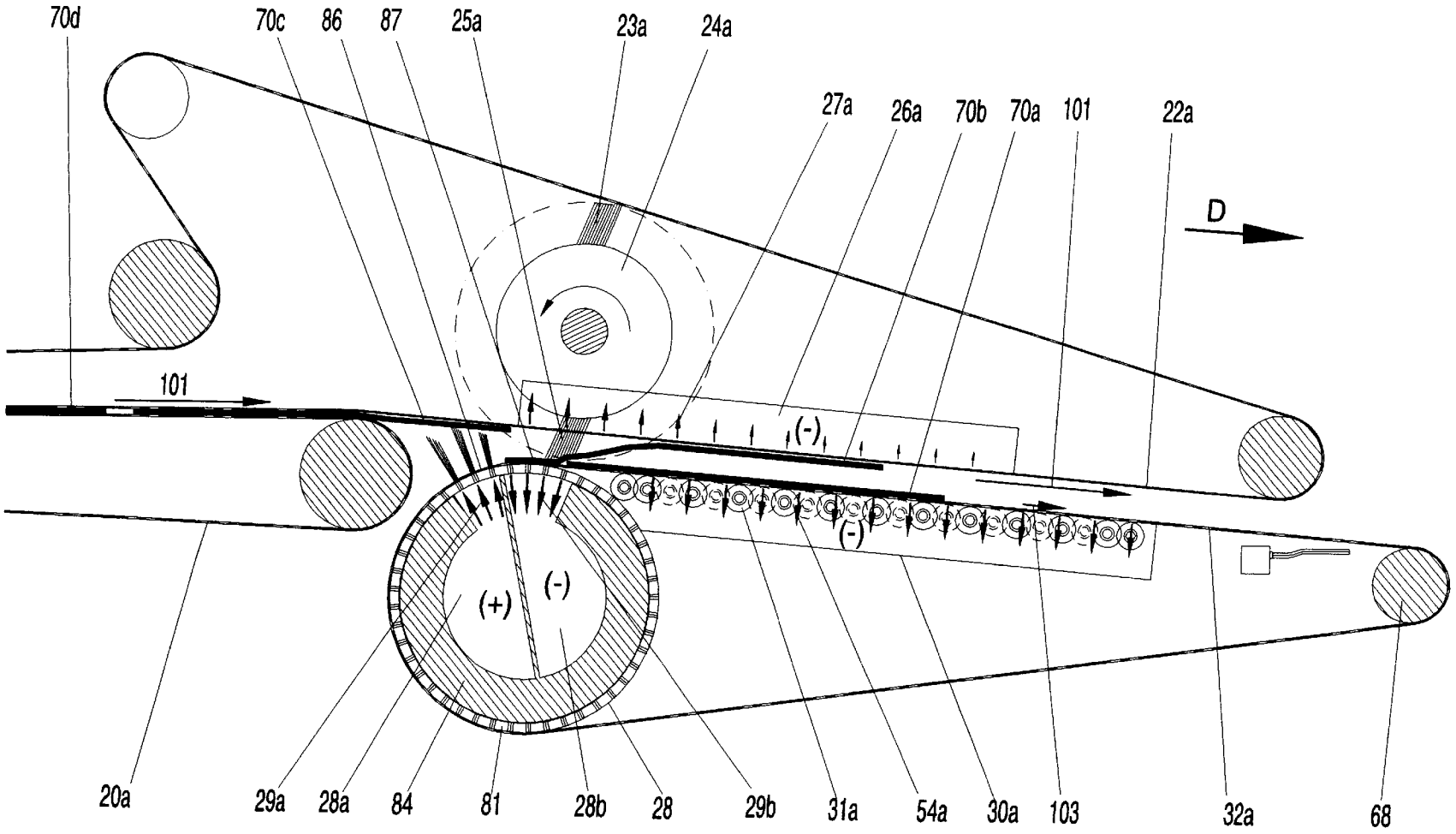
FIG. 3G shows a side cross sectional view of part of the apparatus of FIG. 1, in a seventh state, when first, second, third, and fourth pieces of product are located at sixteenth, seventeenth, eighteenth, and nineteenth positions, respectively.

FIG. 3G shows a side cross sectional view of part of the apparatus 10 of FIG. 1, in a seventh state, when the first piece of product 70*a* is located at a sixteenth position and the second piece of product 70*b* is located at seventeenth position, third piece of product 70*c* is located at the eighteenth positions, and fourth piece of product 70*d* is located at the nineteenth position. The product 70*a* has moved horizontally from the position in FIG. 3F to the position in FIG. 3G, with slow delivery speed 103 and is controlled by perforated slow delivery tapes 32*a–e* by applying suction shown by arrows 54*a–c*, through tapes openings by slow delivery tapes vacuums 30*a–e*. The product 70*b* has moved horizontally in direction D from the position in FIG. 3F to the position in FIG. 3G. Front and middle portion of the product 70*b* shown in FIG. 3G is held by applying suction to the first fast delivery tapes 22*a–f* by fast delivery tape vacuums 26*a–f* (arrows 27*a–f*). Rear portion of the product 70*b* is pressed down by the rotated set of second pressing brushes 25*a–e* from the set of first pressing brushes discs 24*a–e* against vacuum portion 87 of blowing vacuum cylinder 28. In this same state blowing vacuum cylinder 28 sucks down this portion of the product to the surface of cylinder 28 (vacuum portion 87) as shown by arrows 29*b*. Speed of product 70*b* is subject to suction of fast delivery tape vacuum 26*a–f* shown by arrows 27*a–f* and suction off blowing vacuum cylinder 28 shown by arrows 29*b*. Because suction of blowing vacuum cylinder 28 (arrows 29*b*) is greater than suction of upper fast delivery tapes vacuums 26*a–f* (arrows 27*a–f*), and slow delivery speed 103 is 7–10 times smaller than fast delivery tape speed 101, the product 70*b* starts to be controlled by blowing vacuum cylinder 28 and brake down speed from fast delivery tapes speed 101 to the slow delivery speed 103. Front and middle portion of product 70*b* will slip over low friction surface of first fast delivery tapes 22*a–f*.

The product 70*c* has moved horizontally in direction D from the position in FIG. 3F to the position on FIG. 3G. Blowing vacuum cylinder 28 blows air from blowing portion 86 on front portion of the product 70*c* (arrows 29*a*), pressing and holding it against first fast delivery tapes 22*a–f* and keeps product away from suction of blowing vacuum cylinder vacuum portion 87 shown by arrows 29*b*. Middle and rear portion of product 70*c* is fully controlled by first and second fastest delivery tapes 22*a–f* and 20*a–f*. Product 70*c* moves with fast delivery tapes speed 101.

Product 70*d* is fully controlled by delivery tapes 22*a–f* and 20*a–f* and moved horizontally in direction D with fast delivery tapes speed 101.

Figure 3H:
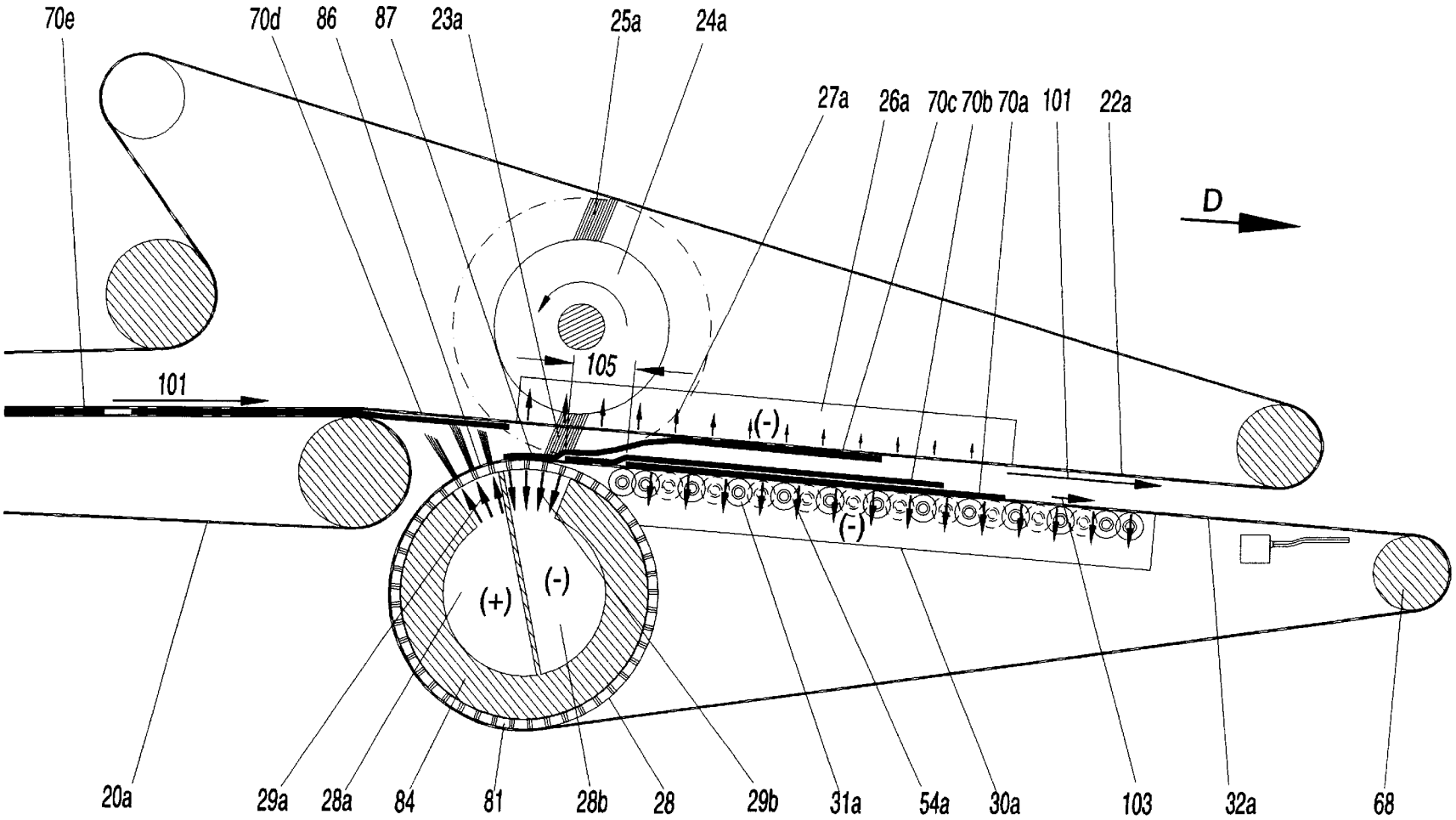
FIG. 3H shows a side cross sectional view of part of the apparatus of FIG. 1, in a eighth state, when first, second, third, fourth, and fifth pieces of product are located at twentieth, twenty-first, twenty-second, twenty-third, and twenty-fourth positions respectively.

FIG. 3H shows a side cross sectional view of part of the apparatus 10 of FIG. 1, in an eighth state, when the first piece of product 70*a* is located at a twentieth position and the second piece of product 70*b* is located at a twenty-first position, the third piece of product 70*c* is located at twenty second position, fourth piece of product 70*d* is located at the twenty-third position, and the fifth piece of product, 70*e*, is located at the twenty-fourth position. The product 70*a* has moved horizontally from the position in FIG. 3G to the position in FIG. 3H, with slow delivery speed 103, product 70*a* is controlled by perforated slow delivery tapes 32*a–e* by applying suction (arrows 54*a–e*) through tapes openings by slow delivery tapes vacuum 30*a–e*. Suction of slow delivery tape vacuum, (arrows 54*a–e* show air suction direction) applies to whole area of product 70*a*. It happens to first product only like product 70*a*.

The product 70*b* has moved horizontally from the position in FIG. 3G to the position in FIG. 3H with slow delivery speed 103, and is controlled by perforated slow delivery tapes 32*a–e*, by applying suction (arrows 54*a–e*) through tape openings by slow delivery tapes vacuums 30*a–e*. Suction of slow delivery tape vacuum applies to overlap portion of product 70*b* only and each next product will be controlled in this same way. Overlap distance 105 shown in FIG. 3H can be controlled by variable slow delivery speed 103 (higher speed, bigger overlap).

The product 70*c* has moved horizontally in direction D from the position in FIG. 3G to the position in FIG. 3H. Front and middle portion of the product 70*c* shown in FIG. 3H is held by applying suction to the first fast delivery tapes 22*a–f* by fast delivery vacuums 26*a–f* (arrows 27*a–f*). Rear portion of the product 70*c* is pressed down by the rotated set of first pressing brushes 23*a–e* (same set of brushes which pressed product 70*a*) from the set of first pressing brushes discs 24*a–e* against vacuum portion 87 of the blowing vacuum cylinder 28. In this same state blowing vacuum cylinder 28 sucks down this portion of the product to its own surface of the cylinder vacuum portion 87 as shown by arrows 29*b*. Speed of product 70*c* is subject to suction of fast delivery tape vacuums 26*a–f* shown by arrows 27*a–f* and suction of blowing vacuum cylinder 28 shown by arrows 29*b*. Because suction of blowing vacuum cylinder 28 (arrows 29*b*) is greater than suction of upper fast delivery tapes vacuum 26*a–f* (arrows 27*a–f*), and slow delivery speed 103 is 7–10 times smaller than fast delivery tapes speed 101, product 70*c* starts to be controlled by blowing vacuum cylinder 28 and brake down speed from fast delivery tapes speed 101 to the slow delivery speed 103. Front and middle portion of the product 70*c* will slip over low friction surface first fast delivery tapes 22*a–f*.

The product 70*d* has moved horizontally in direction D from the position in FIG. 3G to the position on FIG. 3H. Blowing vacuum cylinder 28 blows air from blowing portion 86 on front portion of the product 70*d* (arrows 29*a*) pressing and holding it against first fast delivery tapes 22*a–f* and keeps product away from suction of blowing vacuum cylinder vacuum portion 87 shown by arrows 29*b*. Middle and rear portion of product 70*d* is fully controlled by first and second fast delivery tapes 22*a–f* and 20*a–f*. Product 70*d* moves with fast delivery tapes speed 101.

Product 70*e* is fully controlled by first and second delivery tapes 22*a–f* and 20*a–f* and moved horizontally in direction D with fast delivery tapes speed 101.

Figure 4A:
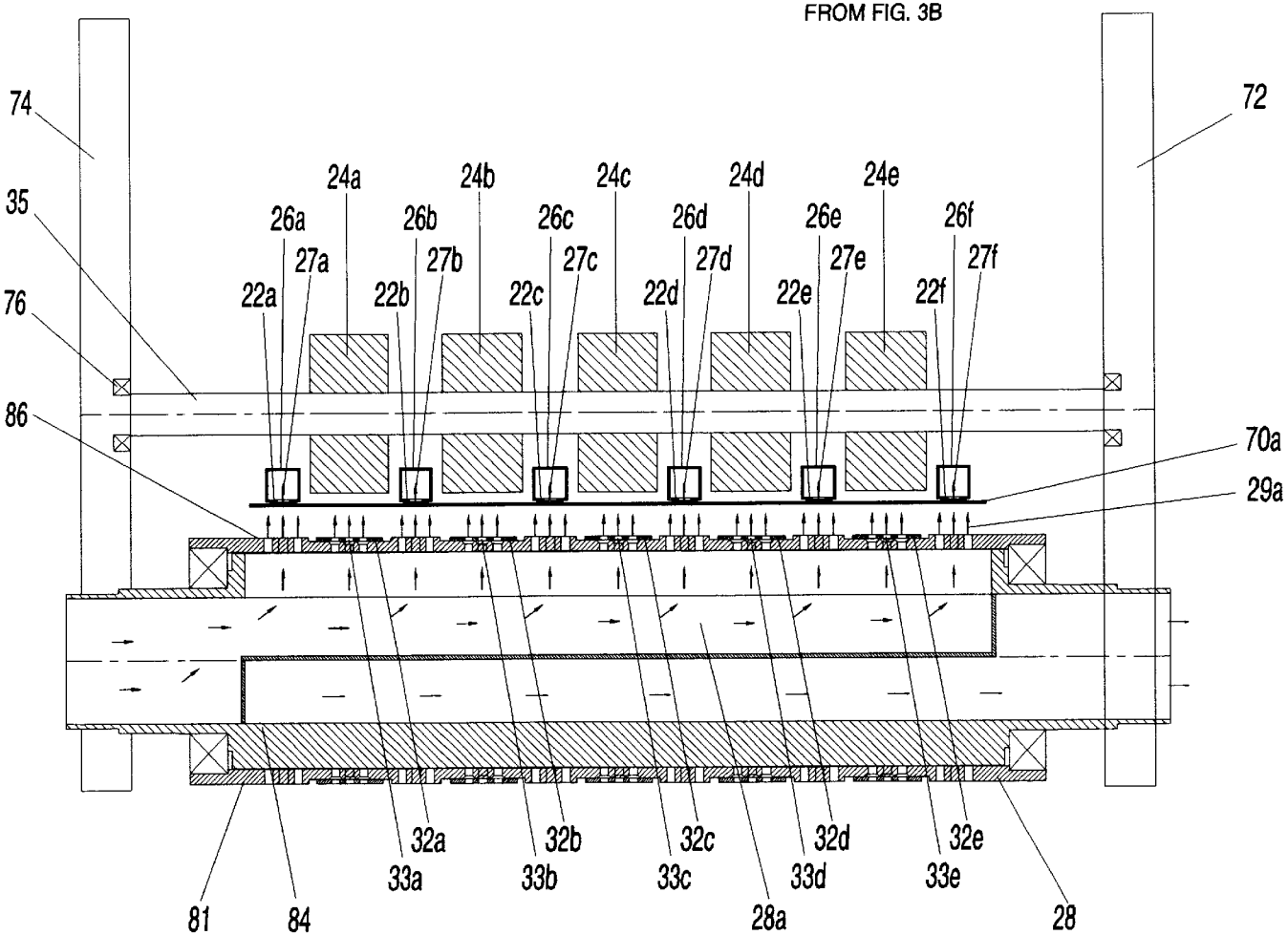
FIG. 4A shows a front cross sectional view from FIG. 3B of part of the apparatus of FIG. 1 including the blowing vacuum cylinder and the pressing brush discs.

FIG. 4A shows a front sectional view of part of the apparatus 10 of FIG. 1 including the blowing vacuum cylinder 28 and the first pressing brush discs 24*a–e* are looking back along line X—X shown in FIG. 3B. FIG. 4A shows that the set 24*a–e* of the first pressing brush discs including discs 24*a*, 24*b*, 24*c*, 24*d*, and 24*e*. First and second pressing brushes 23*a–e* and 25*a–e* are mounted on each pressing brush disc from 24*a* to 24*e* and not shown in FIG. 4A because they are not in active position (see positions of brushes 23*a–e* and 25*a–e* on FIG. 3B). The first pressing brush discs 24*a–e* with brushes 23*a–e* and 25*a–e* rotate with a brush disc shaft 35 with synchronous speed in relation to all products. The brush disc shaft 35 is mounted to members 72 and 74 by brush disc shaft bearings 76 shown by FIG. 4A.

Applying suction (arrows 27*a–f*) holds front and middle portions of product 70*a* to first fast delivery tapes 22*a–f* through tapes perforation by fast delivery tapes vacuums 26*a–f*. Blowing vacuum cylinder 28 blows air from blowing portion 86 on the rear portion of product 70*a* (arrows 29*a*), pressing and holding it against first fast delivery tapes 22*a–f*. Both of them (arrows 27*a–f* and arrow 29*a*) keep product 70*a* away from suction of blowing vacuum cylinder vacuum portion 87 (arrows 29*b*) and suction of slow delivery tapes vacuums 30*a–e* (arrows 54*a–e*) not shown on FIG. 4A, but shown in FIG. 3B). Product 70*a* is moved with fast delivery tapes speed 101. (see FIG. 3B) The fast delivery tape vacuums 26*a–f* can be fixed to housing not shown, which may be fixed to members 72 and 74 shown in FIG. 4A.

Figure 4B:
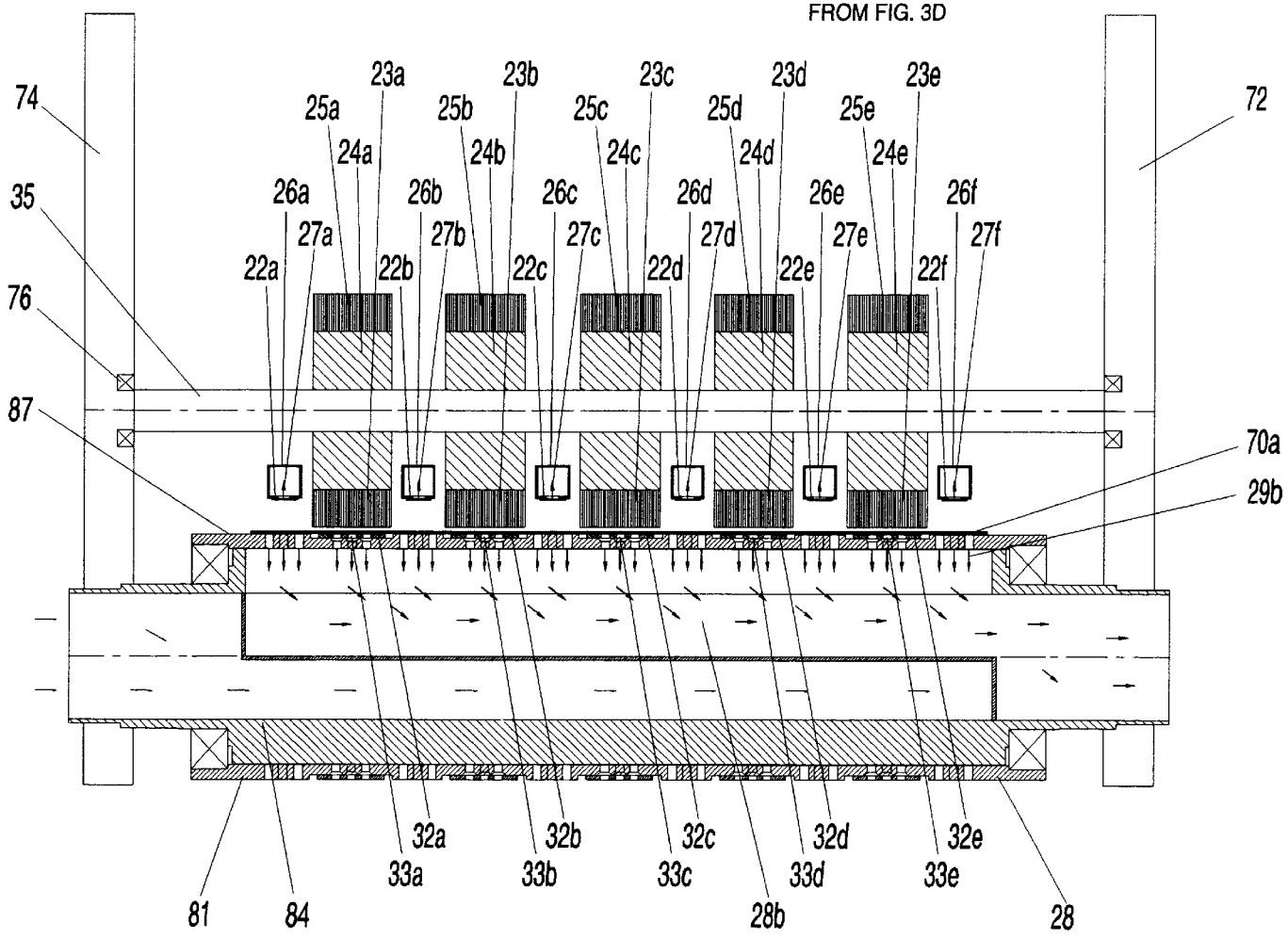
FIG. 4B shows a front cross sectional view from FIG. 3D of the apparatus of FIG. 1 including the blowing vacuum cylinder and the pressing brush discs.

FIG. 4B shows a front sectional view of part of apparatus 10 of FIG. 1 including the blowing vacuum cylinder 28 and the sets of first and second of pressing brushes 23*a–e*, 25*a–e* from first pressing brush discs 24*a–e* and fast delivery tapes vacuums 26*a–f* looking back along line Y—Y shown in FIG. 3D. Rotated first set of pressing brushes 23*a–e* press down rear portion of product 70*a* from the pressing brushes discs 24*a–e* against vacuum portion 87 of blowing vacuum cylinder 28. In this same state, blowing vacuum cylinder 28 sucks down this portion of the product to the surface of the vacuum portion 87 of the cylinder 28 shown by arrows 29*b* on FIG. 4B. Product 70*a* is now moving with slow delivery speed 103 (shown on FIG. 3D).

Figure 4C:
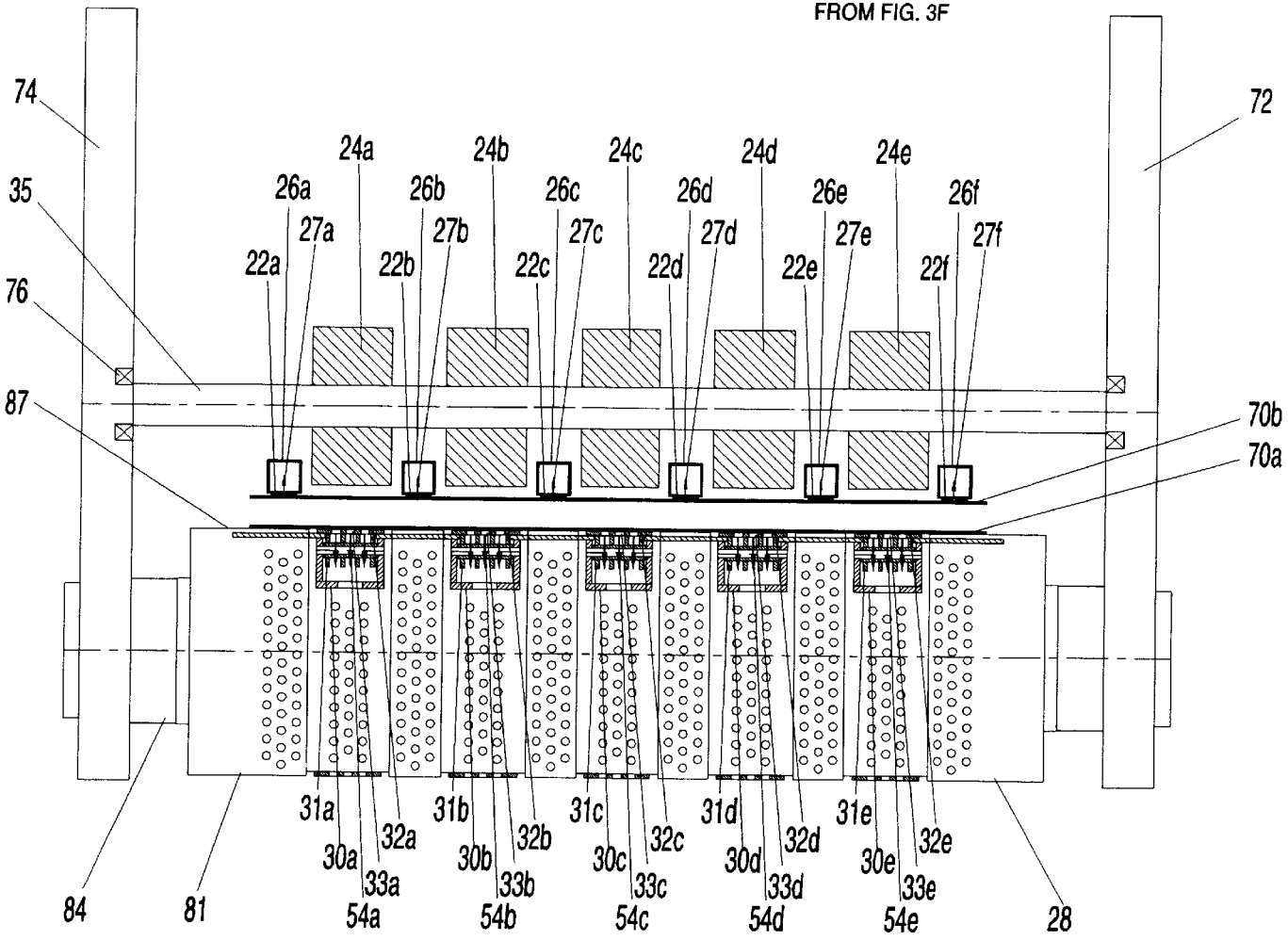
FIG. 4C shows a front cross sectional view from FIG. 3F of the apparatus of FIG. 1 including the blowing vacuum cylinder, pressing brush discs and slow delivery tape vacuums.

FIG. 4C shows a front sectional view of part of apparatus 10 of FIG. 1 including the blowing vacuum cylinder 28 and the first pressing brush discs 24*a–e*, slow delivery tapes vacuums 30*a–e* and fast delivery tape vacuums 26*a–f* looking back along line Z—Z shown in FIG. 3F. Product 70*a* is pressed down against blowing vacuum cylinder 28 and sucked down to the surface of cylinder first and later sucked down to perforated slow delivery tapes 32*a–e* (arrows 54*a–e*) through tapes' perforations 33*a–e* by slow delivery tapes vacuum 30*a–e* shown in FIG. 4C. Slow delivery tapes vacuums 30*a–e* on top portion has large long opening to pass vacuuming air. Slow delivery tapes 32*a–e* are perforated and slide over the slow delivery tapes vacuums 30*a–e* and are supported from the bottom to reduce sliding friction by slow delivery tapes supporting rollers 31*a–e*. Product 70*a* is moving horizontally in direction D with slow delivery speed 103 (shown in FIG. 3*f*). Product 70*b* is held by applying suction to first fast delivery tapes 22*a–f* through perforations in tapes by fast delivery tapes vacuums 26*a–f* shown by arrows 27*a–f*. Fast delivery tapes vacuums 26*a–f* has openings to allow air to come into vacuum chamber. Product 70*b* is moving horizontally in direction D, with fast delivery tape speed 101 (see FIG. 3F) and overlaps product 70*a*.

Each of slow delivery tapes 32*a–e* is perforated. For example, tape 32*a* has perforations 33*a*. Perforations 33*a* allows air to escape from blowing chamber 28*a* of the blowing vacuum cylinder 28 through the slow delivery tape 32*a* FIG. 4A, as shown by air flow arrows 29*a* and also allow air to come into chamber 28*b* through the slow delivery tape 32*a* shown on FIG. 4*b* by air flow arrows 29*b*. This same perforation 33*a* allows air to come into vacuum 30*a* through the slow delivery tape 32*a* as shown in FIG. 4C, as shown by air flow arrow 54*a*. Each perforated slow delivery tape of the set 32*a–e* must ride over its corresponding slow delivery tape vacuum of the set 30*a–e*. The perforations such as perforation 33*a–e* allows air to affect the products such as products 70*a*–70*e*.

The brushes 23*a–e* and 25*a–e* are not shown in FIGS. 4A and 4C because in the state shown they are not in a pressing position.

Figure 5A:
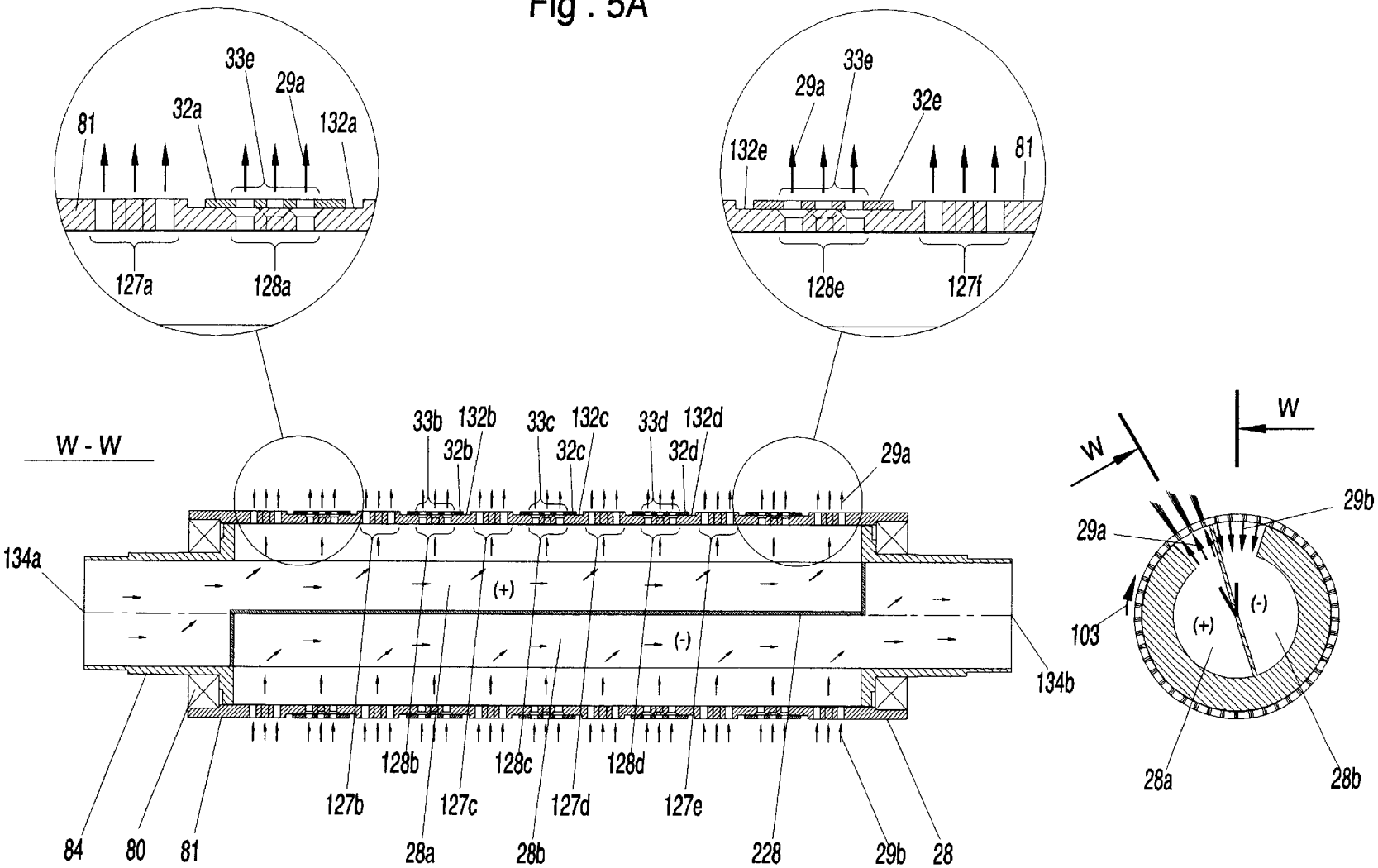
FIG. 5A shows a cross sectional view of a blowing vacuum cylinder for use in the embodiment of FIG. 1.

FIG. 5A shows a cross sectional view of vacuum blowing cylinder 28 for use in the embodiment of FIG. 1 looking along line W—W in FIG. 5A. Blowing vacuum cylinder 28 is built from blowing vacuum cylinder shaft 84 (is not rotated), two larger size blowing vacuum cylinder bearings 80 and blowing vacuum cylinder roller 81 (rotates with peripheral speed-slow delivery speed 103).

Blowing vacuum cylinder roller 81 has a groove 132*a–e* for perforated slow delivery tapes 32*a–e*. Inside the grooves 132*a–e* blowing vacuum cylinder roller has peripheral perforations (holes) 128*a–e* to allow air to pass in (arrows 29*b*) or out (arrows 29*a*) through wall of the roller 81. Each slow delivery tape 32*a* to 32*e* fits into its corresponding grooves 132*a–e* and have own longitudinal perforation (holes) 33*a–e*. To achieve best result of blowing or vacuuming the product 70*a–e*, the peripheral perforation (holes) 128*a–e* of blowing vacuum cylinder roller 81 has to have sink countered holes to easily pass the air through. (See FIG. 5A)

Blowing vacuum cylinder rollers 81 have additional sets of peripheral perforations 127*a–f* between the grooves. Surface between the grooves on blowing vacuum cylinder roller 81 has to be coated with rubber, urethane or by other high friction material to achieve best control of products 70*a–e* when sucked and stuck to roller surface. Product 70 is blown out against first fast delivery tapes or suctioned to surface of blowing vacuum cylinder directly through perforation 127*a–f* and non directly through perforation 128*a–e* (through tape perforation 33*a–e*).

Figure 5C:
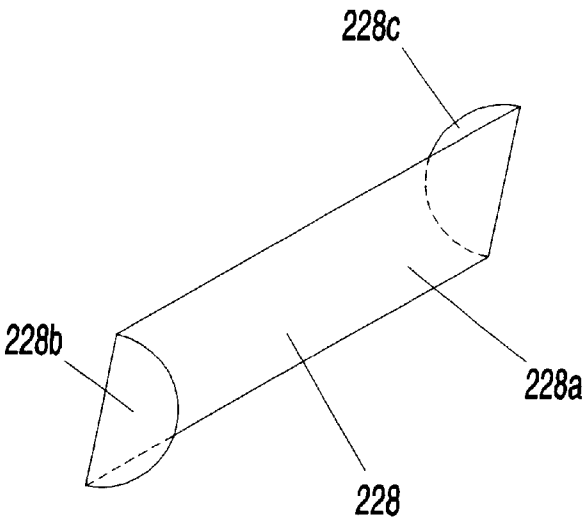
FIG. 5C shows a septum device located inside a blowing vacuum cylinder shaft of FIGS. 5A and 5B.
Figure 5B:
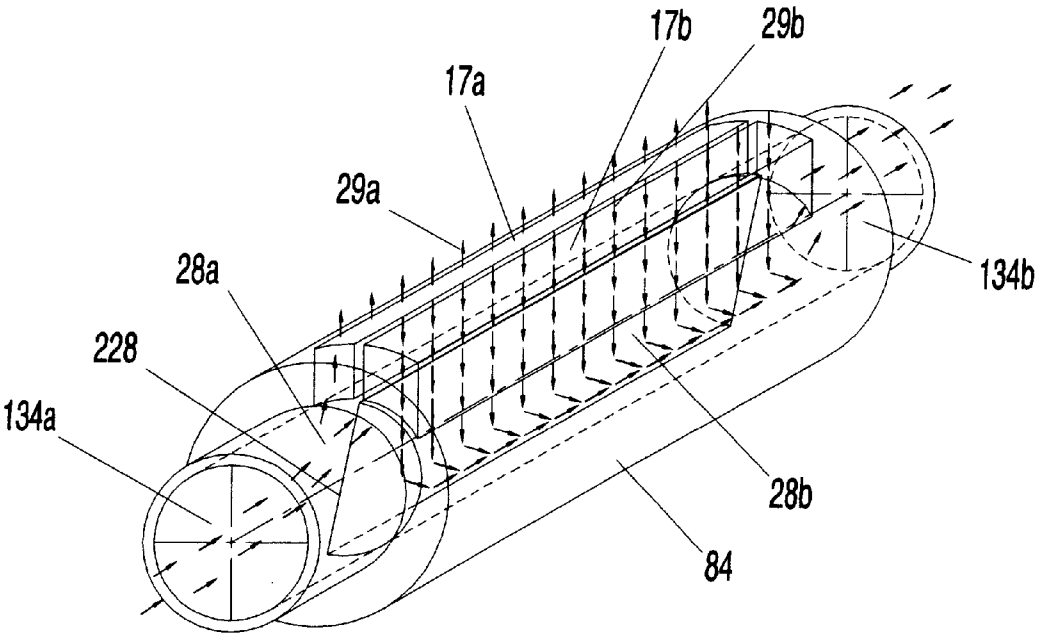
FIG. 5B shows a perspective view of a blowing vacuum cylinder shaft which may be part of the blowing vacuum cylinder of FIG. 5A.
Figure 6A:
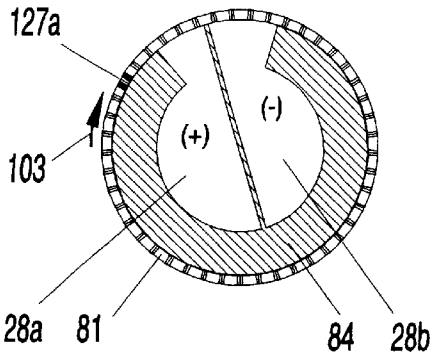
FIGS. 6A–6D shows 4 states of one single opening of perforation from the blowing vacuum cylinder roller in relation to the chambers in the blowing vacuum cylinder shaft.
Figure 6B:
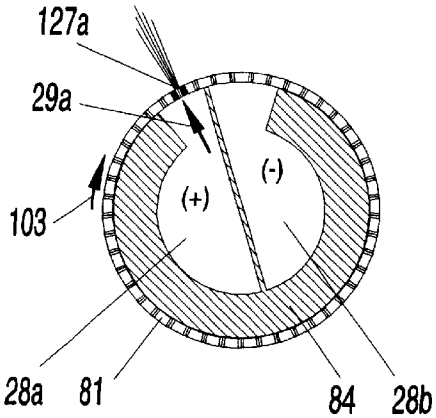
Figure 6C:
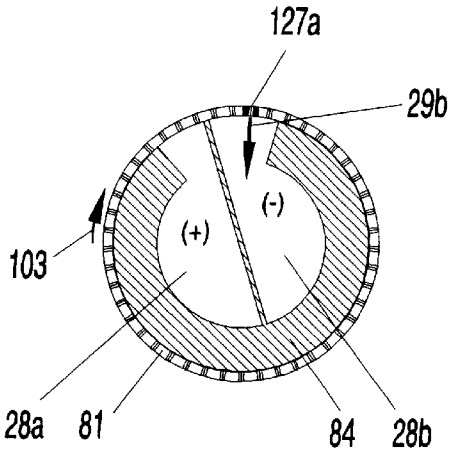
Figure 6D:
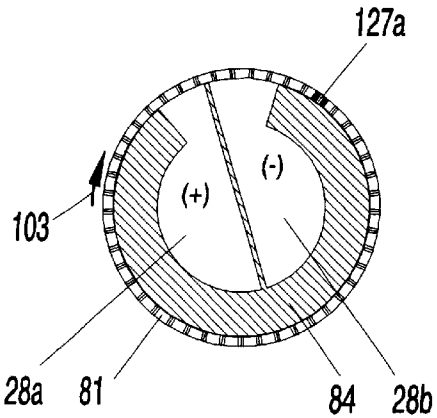

FIG. 5B shows the blowing vacuum cylinder shaft 84. Shaft is hollow and has two openings from two ends 134*a* and 134*b*. Additionally the shaft 84 has two other openings 17*a* and 17*b* located on a cylindrical surface close to each other and parallel to center line of the shaft 84. First one with inserted separator 228 creates blowing chamber 28*a*. Second one with inserted separator 228 creates vacuum chamber

28*b*. Separator 228 is used to form the division inside blowing vacuum cylinder shaft and create the blowing chamber 28*a* and vacuum chamber 28*b* as shown in FIG. 5B.

Air can be blown into opening 134*a* of the blowing chamber 28*a* as shown in FIGS. 5A and 5B. The air then would be emitted out from the blowing chamber 28*a* in the direction shown by arrows 29*a* in FIG. 3A. Air can also be sucked or vacuumed out of the vacuum chamber 28*b* from the opening 134*b*. A suction or vacuum force would then be applied in the direction shown by arrows 29*b* in FIG. 3A. The separator 228 has walls 228*a*, 228*b*, and 228*c*, shown in FIG. 5C which when placed in the blowing vacuum cylinder shaft 84, separate the blowing chamber 28*a* from the vacuum chamber 28*b*.

FIG. 6 shows state of one single opening of perforation 127*a–f* from blowing vacuum cylinder roller 81 in relations to chambers in blowing vacuum cylinder shaft 84 during turning roller with peripheral slow deliver speed 103. FIG. 6A shows no connection between opening 127 and any chambers. Air is not passing through opening. In FIG. 6B the blowing vacuum cylinder roller 81 turns clockwise from position on FIG. 6A to FIG. 6B. Opening 127*a–f* is connected to blowing chamber 28*a* and air is blowing out (arrows 29*a*). In FIG. 6C blowing vacuum cylinder roller 81 turns clockwise from position in FIG. 6B to position in FIG. 6C. Openings 127*a–f* is connected to vacuum chamber 28*b* and air is sucking in (arrows 29*b*). In FIG. 6D, blowing vacuum cylinder roller 81 turns clockwise from position in FIG. 6C to position in FIG. 6D. Openings 127*a–f* are not connected to any vacuum chamber and air is not passing through opening until it reaches the position from FIG. 6B again.

Figure 7A:
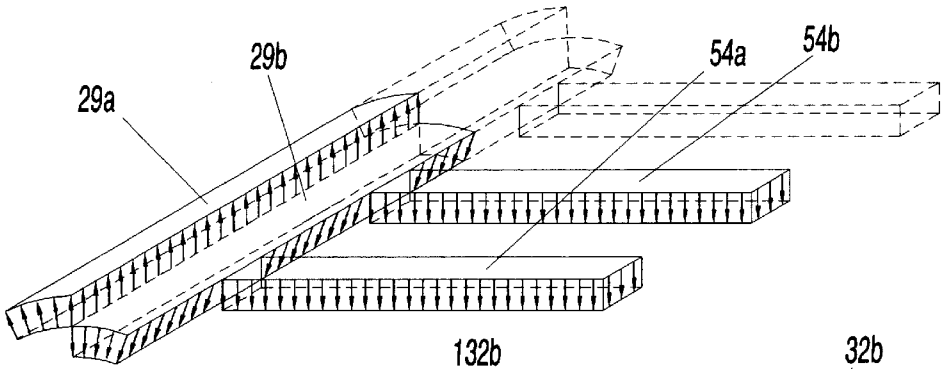
FIG. 7A shows a diagram of the airflow surrounding the blowing vacuum cylinder and slow delivery tapes of FIGS. 3A–H, and 7B.

FIG. 7A shows a diagram of airflow near the blowing vacuum cylinder 28. The arrows 29*a* show the blowing airflow from the blowing chamber 28*a* and correspond to the arrows 29*a* shown in FIG. 3A. The arrows 29*b* show the vacuum airflow for the vacuum chamber 28*b* and correspond to the arrows 29*b* shown in FIG. 3A. The arrows 54*a*–54*b* show vacuum airflow for slow delivery tape vacuums 30*a* and 30*b* shown in FIG. 3A. For simplicity, FIG. 7A does not show air flow from vacuums 30*c*–30*e* (arrows 54*c–e*).

Figure 7B:
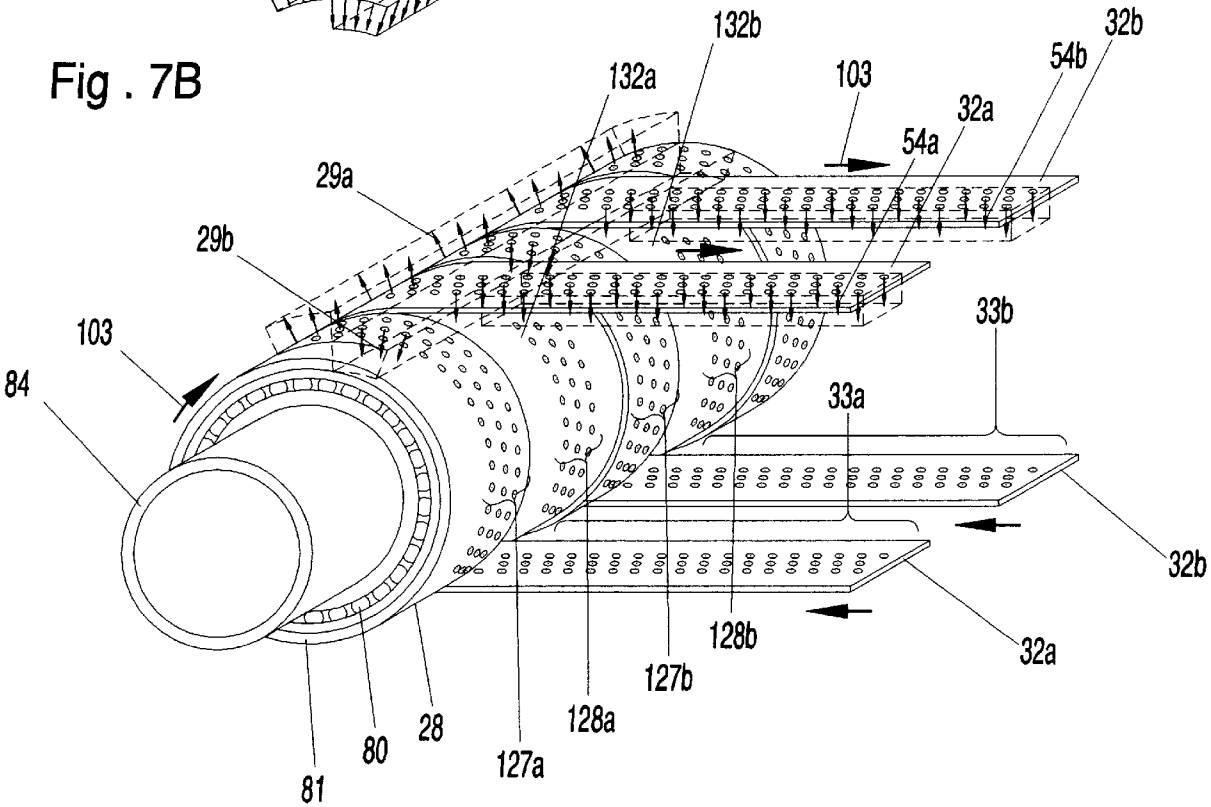
FIG. 7B shows a perspective view of the blowing vacuum cylinder and a plurality of slow delivery tapes and a diagram of the airflow from FIG. 7A.

FIG. 7B shows portion of blowing vacuum cylinder 28 and slow delivery tapes 32*a* and 32*b*. FIG. 7B shows parts of blowing vacuum cylinder including blowing vacuum cylinder shaft 84 with blowing chamber 28*a* and vacuuming chamber 28*b* (shown in FIG. 3B), two bearings 80 installed on both ends of shaft 84 and blowing vacuum cylinder roller 81 shown partially.

The grooves 132*a* and 132*b* on the surface of blowing vacuum cylinder roller 81, into which the tapes 32*a* and 32*b* are placed, respectively, are also shown in FIG. 7B. The grooves 132*c–e* run around the entire circumference of the blowing vacuum cylinder roller 81, as do the grooves 132*a* and 132*b*, which are shown in FIG. 5A but which are not shown in FIG. 7B. Perforations, like perforation 128*a–e*, also run around the entire circumference of the blowing vacuum cylinder roller 81 within each of the grooves 132*a–e*. Slow delivery tapes 32*c–e* have perforations 33*c–e*, as is shown for tape 32*a* which has perforations 33*a* and tape 32*b* which has perforations 33*b* as shown on FIG. 7B. Slow delivery tapes 32*a–e* and blowing vacuum cylinder roller 81 moving with slow delivery speed 103, and perforations 33*a–e*, merge with roller perforation 128*a–e* within roller groves 132*a–e*.

Air will be blown out through some of the perforations 128*a–e* and 33*a–e* and air will be sucked in through other perforations 128*a–e* and 33*a–e*, or neither air blowing or suction will occur, depending on the position of the perforations in relation to the blowing chamber 28*a* and the vacuum chamber 28*b* of the blowing vacuum cylinder shaft 84 shown in FIG. 5A and FIGS. 6A–D. Blowing vacuum cylinder roller has additional perforations 127*a–f* located outside and between groves 132*a–e*, shown on FIG. 7B. These perforations run around the entire circumference of blowing vacuum cylinder roller 81 like perforations 128*a–e*. Perforations 127*a–f* acts in the same manner as perforations 128*a–e* and 33*a–e* described previously except that perforations 127*a–f* have direct contact with the products 70*a–e*.

In operation. a printed continuous web 40 of material incoming to shear cutting section 12. The continuous web 40 is pulled forward by feed roller 44 and pushed between rotary knives cylinder 18 and stationary knife 16 and thereby cut into single items such as single pieces of paper. The continuous web 40 may be cut so those single items having the same size are provided. After cutting, a particular single item is pulled from the rotary knives cylinder 18 into the combination of the set of first fast delivery tapes 22*a–f* and the set of second fast delivery tape 20*a–e*.

First fast delivery tapes 22*a–e* and second fast delivery tapes 20*a–e* have the same tape speed 101 which should be greater than the speed of the feeding of the web 40 by the feed roller 44 at the entrance to the rotary knives cylinder 18. The greater speed of the fast delivery tapes 20*a–f* and 22*a–f* compared to the feed roller 44, creates some separation between items or cut sheets of paper after they are cut off from the web 40.

A single item or piece of paper, such as for example item 70*a* in FIG. 3A starts to move with the same speed as fast delivery tapes 20*a–f* and 22*a–f*, i.e. with speed 101, after leaving the cutting area. To be able to prepare stack a second item, such as item 70*b* in FIG. 3A, and subsequent items on top of the first item, the speed of the first item 70*a* (and then 70*b*, and then the next item) has to be decelerated to slow delivery speed 103, so that a newly cut item can overlap a just previously cut item.

The blowing-vacuum cylinder 28 and set of perforated slow delivery tapes 32*a–e* are used to decelerate the speed and overlap of the items 70*a*, 70*b*, 70*c*, 70*d*, and 70*e* and any further items. Perforated slow delivery tapes 32*a–e* are wrapped around the blowing-vacuum cylinder 28 and run with the same adjustable, slow delivery speed 103 which can be seven to ten times slower that than the speed 101 of the fast delivery tapes 20*a–f* and 22*a–f*. The blowing chamber 28*a* as part of the stationary blowing vacuum cylinder shaft 84 in front blows air against the first fast delivery tapes 22*a–f* to increase the contact between an individual item (such as item or sheet 70*a*) and the first fast delivery tapes 22*a–f* as shown by FIG. 3A. First fast delivery tapes 22*a–f* can be perforated and slide on the bottom surface of fast delivery tape vacuums 26*a–f*. The first fast delivery tape vacuums 26*a–f* apply low air pressure which increases contact between a particular item (such as item 70*a*) and first fast delivery tapes 22*a–f* and keeps a particular item away from blowing vacuum cylinder suction and prevents the item from dropping down to the slow delivery tapes 32*a–e* by the item's own gravity and by the slow delivery vacuum suction (air flow shown by arrows 54*a–c*). When the end of the item, such as item 70*a*, passes blowing vacuum cylinder blowing portion 86, the set of pressing brushes 23*a–e* pushes the tail of the item 70*a* against the blowing vacuum cylinder vacuum portion 87 as shown by FIGS. 3C and 3D. The blowing vacuum cylinder portion 87 sucks the tail of the item 70*a* and sticks it to the surface of cylinder 28 and perforated slow delivery tapes 32*a–e*. From this moment the item 70*a* starts to run with slow delivery tape speed 103, which is seven to ten times slower than the fast delivery tape speed 101 of the first and second fast delivery tapes 20*a–f* and tapes 22*a–f*, because the sucking force of the vacuum chamber 28*b* of the blowing-vacuum cylinder 28 is much greater than the sucking force of the fast delivery tape vacuums 27*a–f* as shown by FIGS. 3C and 3D.

Meanwhile the next item 70*b* still runs with the fast delivery tape speed 101 of tapes 20*a–f* and 22*a–f* and starts to overlap the previous item 70*a*. (see FIGS. 3C, 3D 3E, and 3F). The end of the item 70*b* passes the blowing vacuum cylinder blowing portion 86 and is pushed by the second set of pressing brushes 25*a–e* against blowing vacuum cylinder vacuum portion 87 shown in FIG. 3G. The item 70*b* is then processed in a similar manner to item 70*a*.

When single items, such as item 70*a*, leave contact with the blowing vacuum cylinder vacuum portion 87, the single item is still controlled by perforated slow delivery tapes 32*a–e*. (see FIG. 3G). Under the perforated slow delivery tapes 32*a–e* are located slow delivery tape vacuums 30*a–e*. Each of the slow delivery tape vacuums 30*a–e* is built as a box and each box contains a supporting roller of rollers 31*a–e*, to support the corresponding perforated slow delivery tape of tapes 32*a–e*, respectively, and to reduce friction between each of the slow delivery tapes 32*a–e* and its corresponding vacuum box of vacuum boxes 30*a–e*. A whole single item or sheet (such as item 70*a*), or tails of single items or sheets (such as of the tails of items 70*b–*70*e*, in this example) are sucked by the vacuum 30*a–e* through the perforations on the slow delivery tapes 32*a–e* to increase contact and to control their slow speed 103 as shown by FIGS. 3G and 3H. This is important especially when the apparatus 10 is designated to run with high speed. At the end of the perforated slow delivery tapes 32*a–e*, the process of sucking is finished and single items of product (such as 70*a–*70*e*) are free. Blowing air nozzles 34*a–d* push the sheets against stop plates 36*a–f* and start stacking on piling system 38.

The blowing vacuum cylinder 28 includes blowing vacuum cylinder shaft 84, 2 large vacuum cylinders bearing 80 and blowing vacuum cylinder roller 81.

The outer surface of blowing vacuum cylinder roller 81 has grooves, such as grooves 132*a*–1 32*e*. Inside the grooves 132*a–e*, perforated slow delivery tapes 32*a–e* is installed, respectively. I.e. slow delivery tape 32*a* is installed in combination groove 132*a*. Perforated blowing vacuum cylinder roller 81 and perforated slow delivery tapes 32*a–e* put together form the same even cylindrical shape. Blowing vacuum cylinder roller 81 and slow delivery tapes 32*a–e* are perforated, and have the same pattern, so that air can escape from cylinder 28 or be sucked into the cylinder 28 through the appropriate tape of tapes 32*a–e*. Two large size bearings 80 shown in FIGS. 5A and 7B are seated on large size stationary, blowing vacuum cylinder shaft 84 with openings 134*a* and 134*b* on the ends. Blowing Vacuum cylinder shaft 84 has two axial openings 17*a* and 17*b* next to each other. See FIG. 5B. The first opening 17*a* can be called the front opening and is for blowing air. The second opening 17*b* can be called a rear opening and is vacuuming or sucking in air. Inside of stationary blowing vacuum cylinder shaft 84 we have special shaped septum device 228 (shown in FIG. 5C), which divides the hollow space of the blowing vacuum cylinder shaft 84 into the blowing chamber 28*a* and the vacuum chamber 28*b*. The blowing chamber 28*a* connects left port 134*a* to the front opening 17*a* for blowing air. The vacuum chamber 28*b* connects the port 134*b* to the rear opening 17*b* for vacuuming air shown in FIG. 5B. The blowing chamber 28*a* and the vacuum chamber 28*b* are well isolated. The diagram of the air pressure required to control the moving product 70*a–e* is shown in FIG. 7A.

Figure 8:
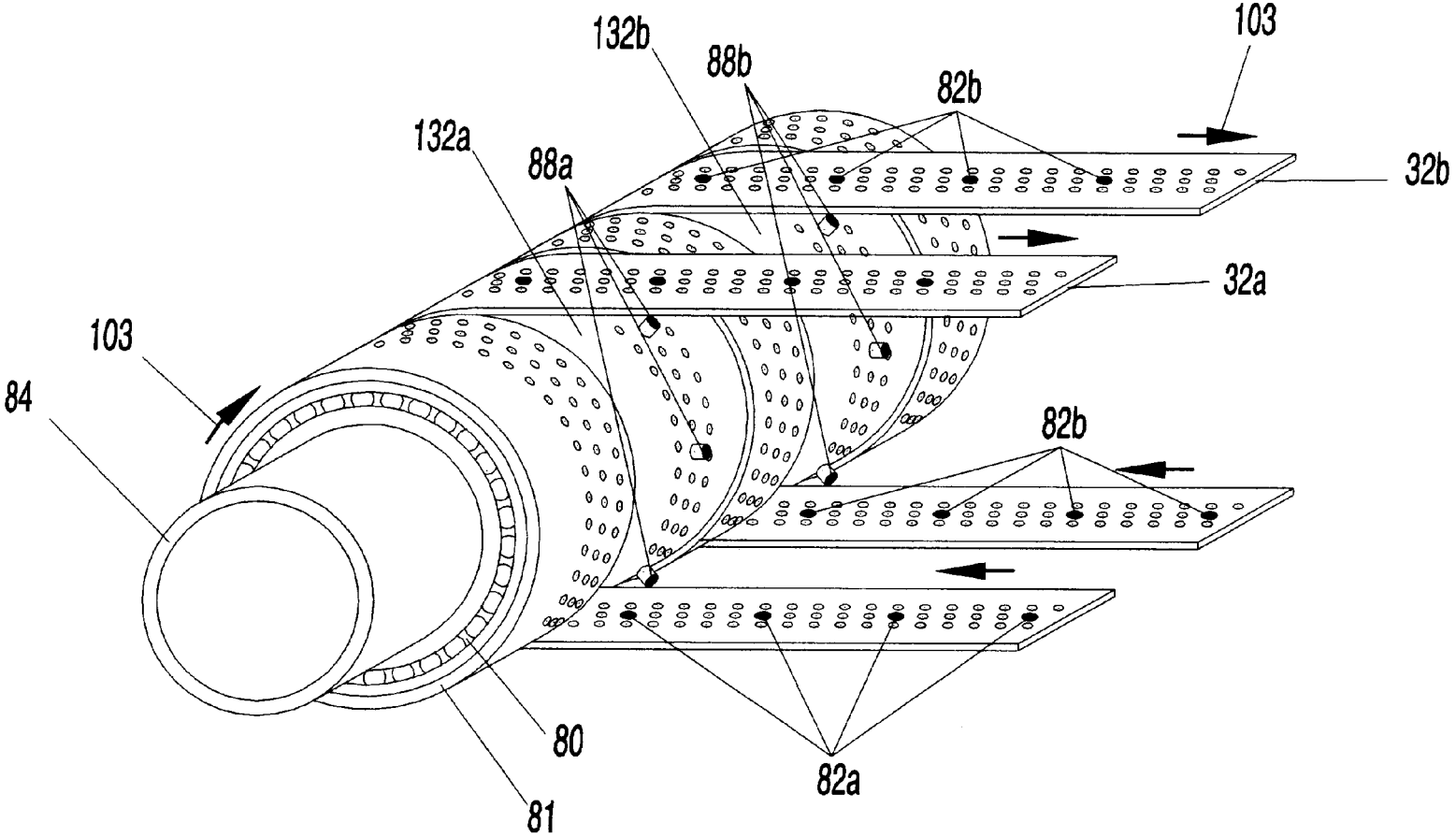
FIG. 8 shows alternative design of synchronization between blowing vacuum cylinder and slow delivery tapes.

To blowing air from blowing chamber 28*a* or suck air into vacuum chamber 28*b* though the blowing vacuum cylinder roller perforation 128*a–e* and slow delivery tapes perforation 33*a–e* should not be a problem specially when perforation holes 128*a–e* in the blowing vacuum cylinder roller 81 are sink counter bored as show in FIG. 5A. This means that for example one hole of the set 128*a*, has a diameter which increases outwards towards the slow delivery tapes for example tape 32*a*. This allows air to spread out and if the tapes 32*a–e* are not perfectly aligned air can still come through the holes, such as holes 128*a–e* and through the tape perforations 33*a–e*, such as set perforations 33*a–e*. To better performance the sets of perforations (openings 128*a–e* and 33*a–e*) can be synchronized, see FIG. 8 as alternative design. In this manner the slow delivery tape perforation pattern (openings 33*a–e*) has the same pattern like blowing vacuum cylinder roller perforations 128*a–e* shown in FIG. 7B. In FIG. 8 the blowing vacuum cylinder roller 81 inside the groves 132*a–e* contains the location pins 88*a–e* with constant circular pith. Slow delivery tapes 32*a–e* contain location holes 82*a* and 82*b* (represent all location holes 82*a–e*) with some pitch distance equal to each pins (of pins 88*a–e*) circumference. When blowing vacuum cylinder roller 81 is rotated with slow delivery speed 103 the slow delivery tape location holes 82*a* and 82*b* (82*a–e*) match blowing vacuum cylinder roller location pins 88*a* and 88*b* (88*a–e*) shown on FIG. 8. In this same time slow delivery tape perforations (openings 33*a* and 33*b* represent all openings 33*a–e*) match blowing vacuum cylinder roller perforations exactly (openings 128*a–e*), see FIG. 7B.

Figure 9:
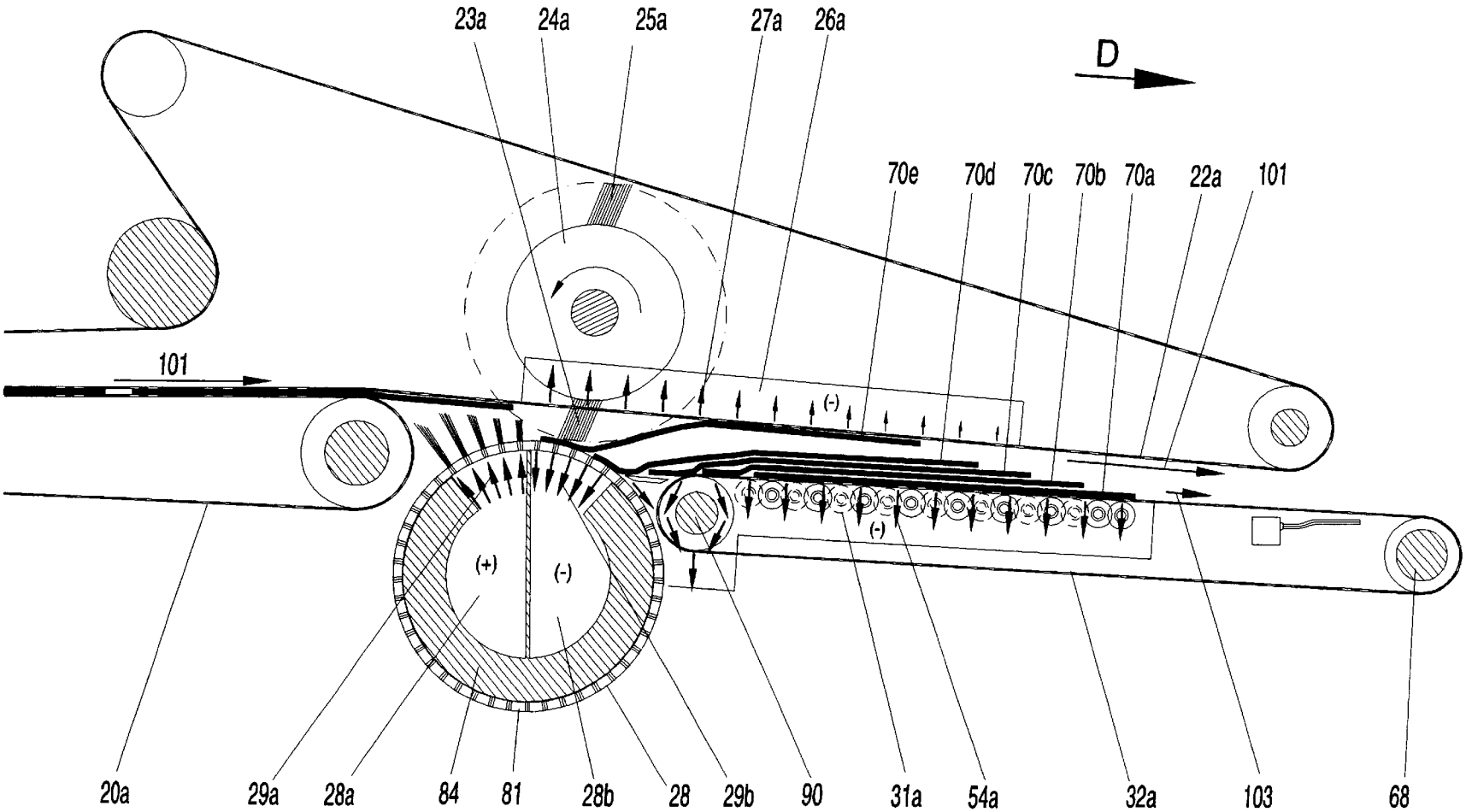
FIG. 9 shows a side cross sectional view alternative design of the part if the apparatus of FIG. 1 which may be an alternative to FIGS. 3A–3H.

FIG. 9 shows a side cross sectional view alternative design of the part of the apparatus of FIG. 1 (alternative to FIGS. 3A–3H). In FIG. 9 slow delivery tapes 32*a–e* is not running around blowing vacuum cylinder 28, they are running around additional slow delivery front roller 90. Blowing vacuum cylinder 28 have own drive (not shown), slow delivery tapes 32*a–e* have drive from slow delivery drive roller 68. Both blowing vacuum cylinder 28 and slow delivery tapes 32*a–e* have the same slow delivery speed 103 see FIG. 9. Advantage of this alternative is more effective blowing (arrows 29*a*) and suction (arrows 29*b*) of blowing vacuum cylinder 28 because blowing and suction are applying direct to product 70*a–e*, not through slow delivery tapes 32*a–e*. Disadvantage of this alternative is requirement install additional drive to drive blowing vacuum cylinder 28 with slow delivery speed 103.

Figure 10:
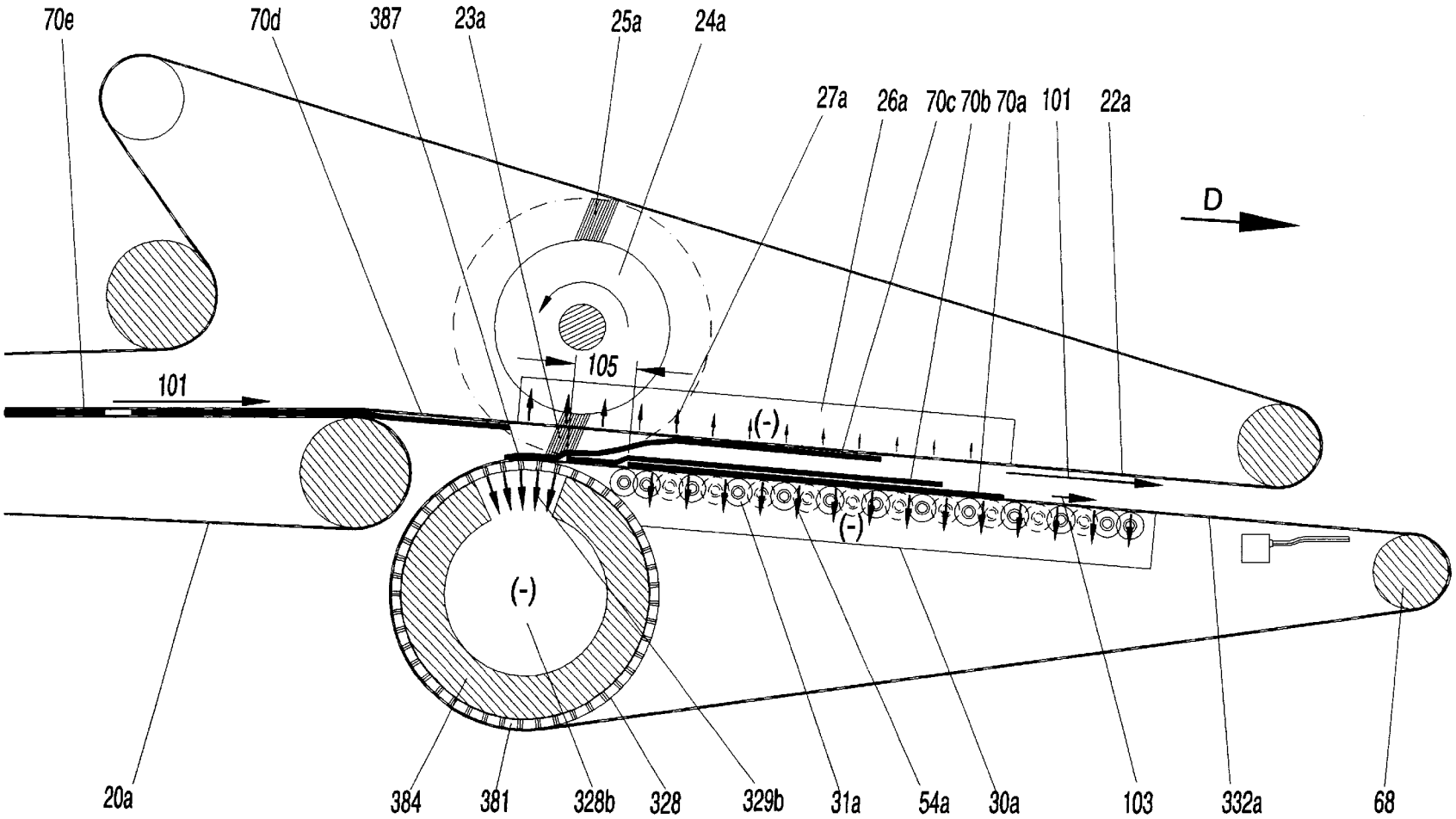
FIG. 10 shows a side cross sectional view of an alternative embodiment of the present invention.

FIG. 10 shows a side cross sectional view of an alternative embodiment of the present invention. In FIG. 10, vacuum cylinder 328 is comprised of vacuum cylinder shaft 384, two large size bearings (not shown) and vacuum cylinder roller 381 similar to blowing vacuum cylinder roller 81 from FIGS. 3A–3H. Vacuum cylinder shaft 384 has only vacuum chamber 328*b* to which sucks air into vacuum cylinder 328 through cylinder roller 381 perforations (arrows 329*b*) FIG. 10 also shows slow delivery tapes 332*a–e* which are wrapped around the vacuum cylinder 328, and they are similar to slow delivery tapes 32*a–e* in FIGS. 3A–3H, Vacuum portion 387 of vacuum cylinder 328 sucks air into cylinder 328 as vacuum portion 87 of blowing vacuum cylinder 28 does in FIGS. 3A–3H. However, vacuum cylinder 328 doesn't blow air from the cylinder like blowing vacuum cylinder 28 from FIGS. 3A–3H. The vacuum cylinder 328 in this state needs only one port for suction and doesn't need any septum device inside the cylinder shaft 384 like blowing vacuum cylinder 28 included. This alternative embodiment is simpler than the embodiment shown in FIGS. 3A–3H and typically works successfully with a rigid product 70.

I claim:

1. An apparatus for moving items comprised of:

a cylinder;

wherein the cylinder is comprised of a vacuum chamber and a blowing chamber;

wherein the cylinder is comprised of a first set of perforations which allow air from the blowing chamber to be blown out of the first set of perforations;

wherein the cylinder is comprised of a second set of perforations, which allow air to be sucked into the vacuum chamber through the second set of perforations; and wherein a piece of paper can pass over the cylinder during a times period and the apparatus is adapted so that during substantially the entire time period the blowing chamber blows air in a first substantially fixed direction out from the blowing chamber, and the vacuum chamber sucks air in a second substantially fixed direction towards the vacuum chamber.

2. The apparatus of claim 1 wherein the first set and the second set of perforations are the same.

3. The apparatus of claim 1 wherein the first set of perforations is different from the second set of perforations and the first set of perforations is adjacent to the second set of perforations.

4. The apparatus of claim 1 wherein the first substantially fixed direction and the second substantially fixed direction are substantially opposite one another.

5. The apparatus of claim 1 wherein the blowing chamber and the vacuum chamber are adapted to be fixed during substantially the entire time period.

6. An apparatus for moving items comprised of:

a cylinder;

wherein the cylinder is comprised of a vacuum chamber and a blowing chamber;

wherein the cylinder is comprised of a first set of perforations which allow air from the blowing chamber to be blown out of the first set of perforations;

wherein the cylinder is comprised of a second set of perforations, which allow air to be sucked into the vacuum chamber through the second set of perforations; and further comprised of:

a first slow delivery tape which is wrapped around the cylinder, and which can transport items.

7. The apparatus of claim 3 further comprised of:

a plurality of first fast delivery tape rollers;

a first fast delivery tape which is wrapped around the plurality of first fast delivery tape rollers; and wherein the first fast delivery tape lies above the first slow delivery tape.

8. The apparatus of claim 7 further comprised of a first brush disc ratably connected to a housing;

the first brush disc including a first brush wherein a first piece of product can be pushed down by the first brush of the first brush disc to move the first piece of product closer towards the cylinder.

9. The apparatus of claim 8 further comprised of a plurality of second fast delivery tape rollers;

a second fast delivery tape which is wrapped around the plurality of second fast delivery tape rollers; and wherein at least a portion of the second fast delivery tape lies below a portion of the first fast delivery tape;

and wherein at least a portion of the first fast delivery tape, and a portion of the second fast delivery tape act together to move items.

10. The apparatus of claim 9 further wherein:

the items are pieces of paper, which come from a continuous web of paper and further comprising a cutting device, which cuts pieces of paper from the continuous web of paper.

11. The apparatus of claim 10 further comprised of a slow delivery tape vacuum wherein the slow delivery tape moves over the slow delivery tape vacuum in order to transport an item;

wherein the slow delivery tape has a plurality of perforations and the slow delivery tape vacuum has an opening;

and wherein the slow delivery tape vacuum draws air in through the perforations in the slow delivery tape and through the opening in the slow delivery tapes vacuum.

12. The apparatus of claim 11 wherein the slow delivery tape vacuum has a supporting roller, on which the slow delivery tape moves.

13. The apparatus of claim 12 further comprised of a fast delivery tape vacuum wherein the first fast delivery tape moves under the fast delivery tape vacuum in order to transport an item;

wherein the first fast delivery tape has a plurality of perforations and the fast delivery tape vacuum has a plurality of perforations;

and wherein the fast delivery tape vacuum draws air in through the perforations in the first fast delivery tape and through the perforations in the fast delivery tapes vacuum.

14. The apparatus of claim 13 wherein:

a first piece of paper is cut from the continuous web of paper by the cutting device the first piece of paper is moved in a first direction by the first and second fast delivery tapes;

a portion of the first piece of paper is pushed upwards by the blowing chamber of the cylinder;

a portion of the first piece of paper is pushed downwards by a first brush of the first brush disc and sucked downwards by the vacuum chamber of the cylinder; and the first piece of paper is further moved in the first direction by the slow delivery tape.

15. The apparatus of claim 14 wherein:

a second piece of paper is cut from the continuous web of paper by the cutting device the second piece of paper is moved in a first direction by the first and second fast delivery tapes;

a portion of the second piece of paper is pushed upwards by the blowing chamber of the cylinder;

a portion of the second piece of paper is pushed downwards by a second brush of the second brush disc and sucked downwards by the vacuum chamber of the cylinder;

the second piece of paper is further moved in the first direction by the slow delivery tape; and the second piece of paper is moved so that it gradually overlaps and eventually is stacked on top of the first piece of paper.

16. The apparatus of claim 13 wherein the fast delivery tape vacuum supplies a varying amount of suction to the fast delivery tape.

17. The apparatus of claim 6 further comprising a plurality of slow delivery tape supporting rollers which support the first slow delivery tape and allow the first slow delivery tape to move.

18. The apparatus of claim 6 wherein the first slow delivery tape is comprised of a plurality of perforations; and wherein each perforation of the first set of the plurality of perforations of the cylinder has a diameter which increases towards the first slow delivery tape so that air blow cut the first set of perforations starts from a narrow opening for each perforation of the first set with a smaller diameter and is blown out a wider opening with a larger diameter for each perforation for the first set.

19. The apparatus of claim 6 wherein the first slow delivery tape is comprised of a plurality of perforations;

the cylinder is comprised of at least one location pin and wherein at least one of the perforations in the first slow delivery tape fits over a location pin of the cylinder.

20. The apparatus of claim 19 wherein the first slow delivery tape is comprised of a plurality of perforations;

the cylinder is comprised of a plurality of location pins and wherein a plurality of perforations in the first slow delivery tape fit over a corresponding plurality of location pins of the cylinder.

21. An apparatus for moving items comprised of:

a cylinder;

wherein the cylinder is comprised of a vacuum chamber, wherein the cylinder is comprised of a first set of perforations, which allow air to be sucked into the vacuum chamber through the first set of perforations; and further comprised of:

a first slow delivery tape which is wrapped around the cylinder, and which can transport items.

22. A method comprising the step of passing a piece of paper over a cylinder during a time period, the cylinder comprised of a vacuum chamber and a blowing chamber;

causing the blowing chamber to blow air in a first substantially fixed direction out from the blowing chamber during substantially the entire time period; and causing the vacuum chamber to suck air in a second substantially fixed direction towards the vacuum chamber during substantially the entire time period.

* * * * *